US009175456B2

(12) United States Patent
Kobayashi et al.

(10) Patent No.: US 9,175,456 B2
(45) Date of Patent: Nov. 3, 2015

(54) HYDRAULIC CONTROL DEVICE FOR WORKING VEHICLE

(75) Inventors: Takeshi Kobayashi, Kasumigaura (JP); Ryouhei Yamashita, Tsuchiura (JP); Hiroshi Matsuzaki, Tsukuba (JP); Yoshinobu Kobayashi, Kasumigaura (JP); Katsumi Ueno, Higashimatsuyama (JP); Masaaki Andou, Tsuchiura (JP)

(73) Assignee: HITACHI CONSTRUCTION MACHINERY CO., LTD., Tokyo (JP)

( * ) Notice: Subject to any disclaimer, the term of this patent is extended or adjusted under 35 U.S.C. 154(b) by 368 days.

(21) Appl. No.: 13/640,394

(22) PCT Filed: Jun. 17, 2011

(86) PCT No.: PCT/JP2011/063920

§ 371 (c)(1),
(2), (4) Date: Oct. 10, 2012

(87) PCT Pub. No.: WO2011/162179

PCT Pub. Date: Dec. 29, 2011

(65) Prior Publication Data

US 2013/0125539 A1 May 23, 2013

(30) Foreign Application Priority Data

Jun. 22, 2010 (JP) ..... 2010-141587

(51) Int. Cl.

| | |
|---|---|
| ***F15B 1/02*** | (2006.01) |
| ***E02F 9/22*** | (2006.01) |
| ***F15B 1/027*** | (2006.01) |

(52) U.S. Cl.

CPC ..... *E02F 9/2278* (2013.01); *E02F 9/2207* (2013.01); *E02F 9/2217* (2013.01); *E02F 9/2267* (2013.01); *E02F 9/2282* (2013.01); *E02F 9/2285* (2013.01); *E02F 9/2296* (2013.01); *F15B 1/027* (2013.01); *F15B 2211/20523* (2013.01); *F15B 2211/20546* (2013.01); *F15B 2211/3116* (2013.01); *F15B 2211/615* (2013.01); *F15B 2211/625* (2013.01); *F15B 2211/8613* (2013.01)

(58) Field of Classification Search

CPC ..... E02F 9/2214; E02F 9/2207; F15B 1/021
See application file for complete search history.

(56) References Cited

U.S. PATENT DOCUMENTS

| | | | | |
|---|---|---|---|---|
| 3,759,292 | A * | 9/1973 | Bianchetta et al. | 137/596 |
| 5,802,847 | A * | 9/1998 | Harnischfeger | 60/413 |

(Continued)

FOREIGN PATENT DOCUMENTS

| | | |
|---|---|---|
| JP | 57-176904 | 11/1982 |
| JP | 2001-200804 A | 7/2001 |
| JP | 2002-054603 A1 | 2/2002 |

(Continued)

*Primary Examiner* — Nathaniel Wiehe
*Assistant Examiner* — Dustin T Nguyen
(74) *Attorney, Agent, or Firm* — Mattingly & Malur, PC

(57) ABSTRACT

A boom control valve and a pulsation absorption control valve are provided in the halfway point of a center bypass line. The pulsation absorption control valve is arranged in a position downstream of the boom control valve. The pulsation absorption control valve is switched to a blockade position and a communication position by a pilot pressure from a remote control valve. The pulsation absorption control valve is constituted such that one main line out of a pair of main lines is communicated with or blocked off from an accumulator via one communication line and the other main line is communicated with or blocked off from the side of a tank via the other communication line. The accumulator is operated as a dynamic damper at the traveling of a vehicle. This arrangement enables the construction of the communication line to be simplified, thus improving operability at assembling.

10 Claims, 24 Drawing Sheets

(56) References Cited

U.S. PATENT DOCUMENTS

| | | | | |
|---|---|---|---|---|
| 2004/0239177 | A1* | 12/2004 | Kusano et al. | 303/119.1 |
| 2006/0156714 | A1* | 7/2006 | Kim | 60/422 |
| 2011/0173958 | A1* | 7/2011 | Masuda et al. | 60/285 |

FOREIGN PATENT DOCUMENTS

| | | | |
|---|---|---|---|
| JP | 2005-249039 | A | 9/2005 |
| JP | 2007-162387 | A | 6/2007 |
| WO | 2005/035883 | A1 | 4/2005 |

* cited by examiner

HYDRAULIC CONTROL DEVICE FOR WORKING VEHICLE

TECHNICAL FIELD

The present invention relates to a hydraulic control device for a working vehicle suitably used for a working vehicle such as a wheel loader or the like.

BACKGROUND ART

In general, there is known a hydraulic control device used in a working vehicle such as a wheel loader or the like, which is equipped with a dynamic damper to reduce vibrations at traveling for improving ride comfort (Patent Documents 1, 2, 3 and 4).

In the conventional art of this type, a bottom-side oil chamber in a boom cylinder provided in the working mechanism of the wheel loader is connected via communication lines such as hoses, pipes or the like to an accumulator. At the traveling of the wheel loader, pressure pulsations generated due to vibrations of a bucket as a weight load are absorbed by the accumulator for a vibration reduction in a vehicle and an improvement of the ride comfort thereof.

PRIOR ART DOCUMENTS

Patent Documents

Patent Document 1: Japanese Patent Laid-Open No. 2001-200804 A

Patent Document 2: Japanese Patent Laid-Open No. 2005-249039 A

Patent Document 3: Japanese Patent Laid-Open No. 2007-162387 A

Patent Document 4: WO2005/035883

SUMMARY OF THE INVENTION

Incidentally in the aforementioned conventional art, the communication line for establishing connection between the bottom-side oil chamber of the boom cylinder in the working mechanism and the accumulator is constituted by using a plurality of hydraulic pipes. Therefore, the constitution of the communication line becomes complicated, which raises a problem that it is difficult to improve operability at assembling and in addition to it, downsizing and space saving of an entire device can not be achieved.

The present invention is made in view of the aforementioned problem in the conventional art, and an object of the present invention is to provide a hydraulic control device for a working vehicle which can simplify the construction of a communication line to improve operability at assembling, and in addition to it, can achieve downsizing and space saving of an entire device.

(1) In order to solve the above problem, a hydraulic control device for a working vehicle according to the present invention comprises a hydraulic pump constituting a hydraulic source for the working vehicle together with a tank; at least one or more hydraulic actuators driven by pressurized oil discharged from the hydraulic pump; a directional control valve for controlling switching of the pressurized oil to be supplied to the hydraulic actuator from the hydraulic pump; a pair of main lines for establishing connection between the directional control valve and the hydraulic actuator; an accumulator connected via one communication line branched from one main line out of the pair of the main lines to the hydraulic actuator to absorb pressure pulsations generated in the hydraulic actuator; and a pulsation absorption control valve provided in the halfway point of the one communication line to establish or block communication between the hydraulic actuator and the accumulator; wherein the directional control valve is arranged in the halfway point of a center bypass line for connecting the hydraulic pump to the tank to control switching of the pair of the main lines together with the center bypass line.

The construction adopted by the present invention is characterized in a point that the one main line out of the pair of the main lines is connected to the one communication line in a position between the directional control valve and the pulsation absorption control valve, and the other main line is connected to the other communication line which is communicated with or blocked off from the tank through the pulsation absorption control valve, and the pulsation absorption control valve is arranged in the halfway position of the center bypass line to be adjacent to the directional control valve and includes a plurality of switching positions for establishing or blocking communication of the one communication line positioned between the one main line and the accumulator and for establishing or blocking communication of the other communication line positioned between the other main line and the tank.

With this arrangement, when the pulsation absorption control valve arranged in a position adjacent to the directional control valve provided in the halfway point of the center bypass line is switched to either one of the plurality of the switching positions, the one communication line can be communicated with or blocked off from the one predetermined main line out of the pair of the main lines. This arrangement enables the hydraulic actuator (for example, bottom-side oil chamber) to be communicated with or blocked off from the accumulator. In this case, the one main line and the other communication line can be linearly connected to the pair of the main lines by a short distance to simplify the construction of each communication line, thus improving operability at assembling. As a result, it is possible to suppress pressure losses of the pressurized oil flowing in the one communication line between the hydraulic actuator and the accumulator to be small and to achieve downsizing and space saving of the entire device.

(2) According to the present invention, the pulsation absorption control valve is provided in the center bypass line in a position downstream of the directional control valve. With this construction, when the pulsation absorption control valve arranged in the position downstream of the directional control valve provided in the halfway point of the center bypass line is switched to either one of the plurality of the switching positions, the one communication line can be communicated with or blocked off from the one predetermined main line out of the pair of the main lines.

(3) The present invention comprises an engine for driving the hydraulic pump and an exhaust gas purifying device including a filter provided in the exhaust side of the engine to purify an exhaust gas, wherein the pulsation absorption control valve has a switching position for load generation for generating a hydraulic load by throttling a flow passage area of the center bypass line at the time of regenerating the filter in the exhaust gas purifying device.

With this arrangement, when the pulsation absorption control valve is switched to the switching position for load generation at the time of regenerating the filter in the exhaust gas purifying device, the hydraulic load can be generated by throttling the flow passage area of the center bypass line. Therefore, since the load for the engine to drive the hydraulic pump for rotation is increased, when an injection amount of fuel is increased with an increase of the load, a combustion temperature of the fuel can be increased to increase the engine output. As a result, a temperature of the exhaust gas can be increased. Therefore, even in a state where particulate matter is deposited in the filter in the exhaust gas purifying device, and a differential pressure in an exhaust gas between an inlet side and an outlet side of the exhaust gas purifying device is made larger than a predetermined pressure value, the temperature of the exhaust gas can be increased to a temperature necessary for regenerating the filter.

As a result, the exhaust gas having a high temperature can be introduced into the exhaust gas purifying device, and the particulate matter deposited in the filter can be burned and cut with the high-temperature gas to smoothly regenerate the filter. Accordingly, even if the temperature of the exhaust gas is lowered in a state where the engine is operated in a small load condition, the filter can be regenerated by burning the particulate matter deposited in the filter. Therefore, the purifying treatment of the exhaust gas can be stably executed to improve reliability of the exhaust gas purifying device.

(4) The present invention comprises an engine for driving the hydraulic pump and an exhaust gas purifying device including a filter provided in the exhaust side of the engine to purify an exhaust gas, wherein the pulsation absorption control valve includes a short circuit passage for short-circuiting the center bypass line to the side of the tank for communication and has a switching position for load generation for generating a hydraulic load by throttling a flow passage area in the short circuit passage at the time of regenerating the filter in the exhaust gas purifying device.

With this arrangement, when the pulsation absorption control valve is switched to the switching position for load generation at the time of regenerating the filter in the exhaust gas purifying device, the hydraulic load can be generated by throttling the flow passage area in the short circuit passage for short-circuiting the center bypass line to the tank side for communication. Therefore, the purifying treatment of the exhaust gas can continue to be executed by regenerating the filter in the exhaust gas purifying device.

(5) According to the present invention, the pulsation absorption control valve includes first, second, and third switching positions, wherein in the first switching position of these switching positions, the communication between the hydraulic actuator and the accumulator is blocked off in the halfway position of the one communication line, in the second switching position, the communication between the hydraulic actuator and the accumulator is established via the one communication line, and the third switching position is constituted as the switching position for load generation.

With this arrangement, since the pulsation absorption control valve includes the first, second, and third switching positions, when the pulsation absorption control valve is displaced to the first switching position, the communication between the hydraulic actuator and the accumulator can be blocked off in the halfway position of the one communication line, and when the pulsation absorption control valve is switched from the first switching position to the second switching position, the communication between the hydraulic actuator and the accumulator can be established via the one communication line. On the other hand, when the pulsation absorption control valve is switched to the third switching position, the hydraulic load can be generated by throttling the flow passage area of the center bypass line or the short circuit passage.

(6) According to the present invention, the directional control valve and the pulsation absorption control valve are provided in a same valve housing, and the respective communication lines are communicated with the pair of the main lines inside the valve housing. Therefore, the pressure loss of the pressurized oil flowing inside the communication line can be further reduced to achieve downsizing and space saving of the entire device.

(7) According to the present invention, the pulsation absorption control valve and the directional control valve are provided in a parallel arrangement in such a manner as to extend in parallel with each other on the same plane. Therefore, the downsizing and the space saving of the entire device can be furthermore achieved.

(8) According to the present invention, a bypass passage is provided between the hydraulic actuator and the accumulator for establishing communication therebetween even when the pulsation absorption control valve is in either one of the switching positions, and the bypass passage is provided with a switching valve for blocking the communication between the hydraulic actuator and the accumulator by the bypass passage when a pressure in the side of the hydraulic actuator exceeds a predetermined set pressure.

With this arrangement, when the pressure in the side of the hydraulic actuator is increased to a pressure exceeding the set pressure of the accumulator, the communication between the hydraulic actuator and the accumulator via the bypass passage can be blocked by the switching valve, thus preventing an excessive pressure from exerting on the accumulator.

(9) According to the present invention, the switching valve is provided inside the pulsation absorption control valve. Therefore, the downsizing and the space saving of the entire device can be furthermore achieved.

(10) According to the present invention, the bypass passage is provided with a check valve for allowing a flow of pressurized oil from the hydraulic actuator to the accumulator and preventing a reverse flow thereof. Therefore, the flow and the resupply of the pressurized oil from the hydraulic actuator toward the accumulator can be allowed to prevent the event that the pressure in the accumulator is excessively lowered, thus stabilizing an operation of the accumulator.

(11) According to the present invention, the check valve is provided inside the switching valve. Therefore, the downsizing and the space saving of the entire device can be achieved.

MODE FOR CARRYING OUT THE INVENTION

Figure 1:
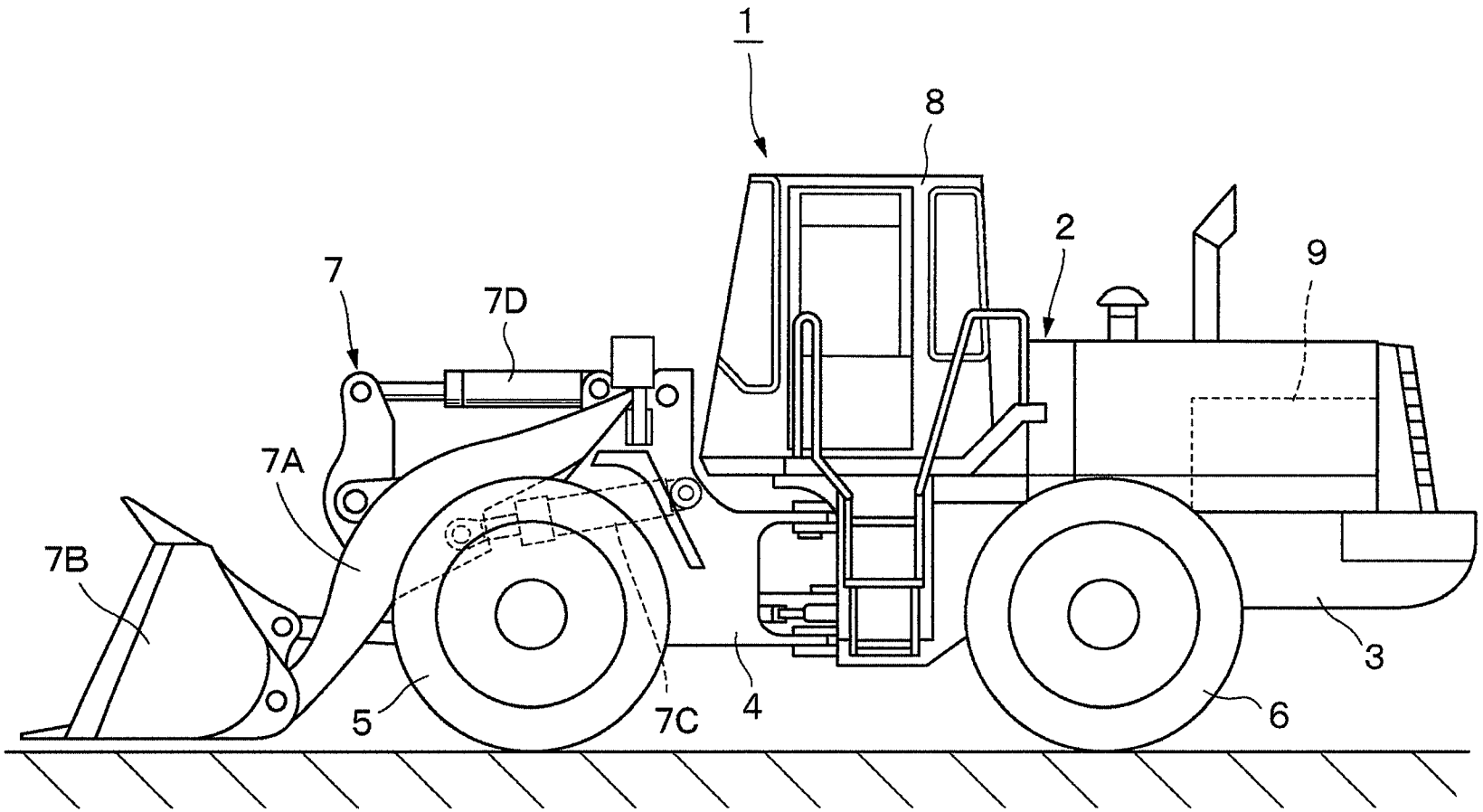
FIG. 1 is a front view showing a wheel loader equipped with a hydraulic control device according to a first embodiment of the present invention.

Hereinafter, a case where a hydraulic control device for a working vehicle according to an embodiment of the present invention is applied to a wheel loader will be in detail explained with reference to the accompanying drawings, as an example.

FIG. 1 to FIG. 7 show a hydraulic control device for a working vehicle according to a first embodiment in the present invention.

In the figure, designated at 1 is a wheel loader as a working vehicle adopted in the first embodiment. The wheel loader 1 has a vehicle body 2 capable of self-traveling by rear wheels 6 and front wheels 5 to be described later.

The vehicle body 2 in the wheel loader 1 comprises a rear vehicle body 3 and a front vehicle body 4 coupled to the front side of the rear vehicle body 3. At the time of performing a steering operation of the wheel loader 1, the wheel loader 1 is steered in the traveling direction such that the front vehicle body 4 swings in the right-left side to the rear vehicle body 3. Right and left front wheels 5 are provided in the front vehicle body 4, and right and left rear wheels 6 are provided in the rear vehicle body 3.

These front wheels 5 and rear wheels 6 constitute wheels of the wheel loader 1 and are four-wheel-driven by a hydraulic motor (not shown) for traveling using a hydraulic closed circuit (Hydrostatic Transmission: HST), for example. It should be noted that the wheel loader 1 as the working vehicle adopted by the present invention is not limited to the four-wheel drive, and, for example, may be a working vehicle in which the front wheels 5 or the rear wheels 6 only are driven.

Indicated at 7 is a working mechanism provided in the front side of the vehicle body 2, and the working mechanism 7 is constituted schematically by a boom 7A mounted liftably in the front vehicle body 4, a loader bucket 7B mounted rotatably in the front end side of the boom 7A, a pair of right and left boom cylinders 7C (refer to FIG. 2) composed of hydraulic cylinders for raising/lowering the boom 7A vertically, and a bucket cylinder 7D for vertically rotating the loader bucket 7B. The working mechanism 7 uses the loader bucket 7B to perform an excavating operation and a shoveling operation of earth and sand, for example.

Indicated at 8 is a cab provided in the front side position of the rear vehicle body 3, and the cab 8 is positioned in rear of the working mechanism 7 to form an operation driving section for an operator mounted on the vehicle body 2. The cab 8 defines a driving room where an operator gets in/off therein. A driving seat, a steering handle, a traveling pedal, and a working lever (any of them is not shown), and further, an indicating switch 54 for a dynamic damper to be described later are disposed in the cab 8.

Indicated at 9 is an engine (refer to FIG. 2) arranged in the rear side of the rear vehicle body 3, and the engine 9 is mounted as a prime mover of the wheel loader 1 and is constituted by, for example, a diesel engine. The engine 9 is provided with an exhaust gas purifying device connected to the halfway point of an exhaust pipe constituting a part of an exhaust gas passage (any of them is not shown).

Indicated at 10 is the hydraulic pump driven by the engine 9 for rotation, and the hydraulic pump 10 constitutes a hydraulic source of the wheel loader 1 together with an operating oil tank 11 (hereinafter, called a tank 11). The hydraulic pump 10 is formed of a variable displacement type swash plate, or a bent axis type or a radial piston type hydraulic pump. The hydraulic pump 10 includes a displacement variable portion 10A composed of a swash plate, a valve plate or the like, and the displacement variable portion 10A is driven by a regulator 12 to be described later.

Indicated at 12 is the regulator attached to the hydraulic pump 10, and the regulator 12 constitutes displacement control means for variably controlling a displacement of the hydraulic pump 10 by a so-called negative control. A differential pressure between upstream and downstream of a throttle 47 is supplied via control lines 48A and 48B to be described later to the regulator 12 as a control pressure for the negative control. The regulator 12 drives the displacement variable portion 10A in the hydraulic pump 10 in response to the control pressure to variably control a discharge volume (displacement) of the hydraulic pump 10 in such a manner that the differential pressure is controlled within a predetermined pressure range.

Indicated at 13 is a discharge line connected to the discharge side of the main hydraulic pump 10, and the discharge line 13 has a front end side connected to a supply line 19 and a center bypass line 21 of pressurized oil, which will be described later. The pressurized oil discharged from the hydraulic pump 10 is supplied from the discharge line 13 toward the supply line 19 and the center bypass line 21.

Figure 3:
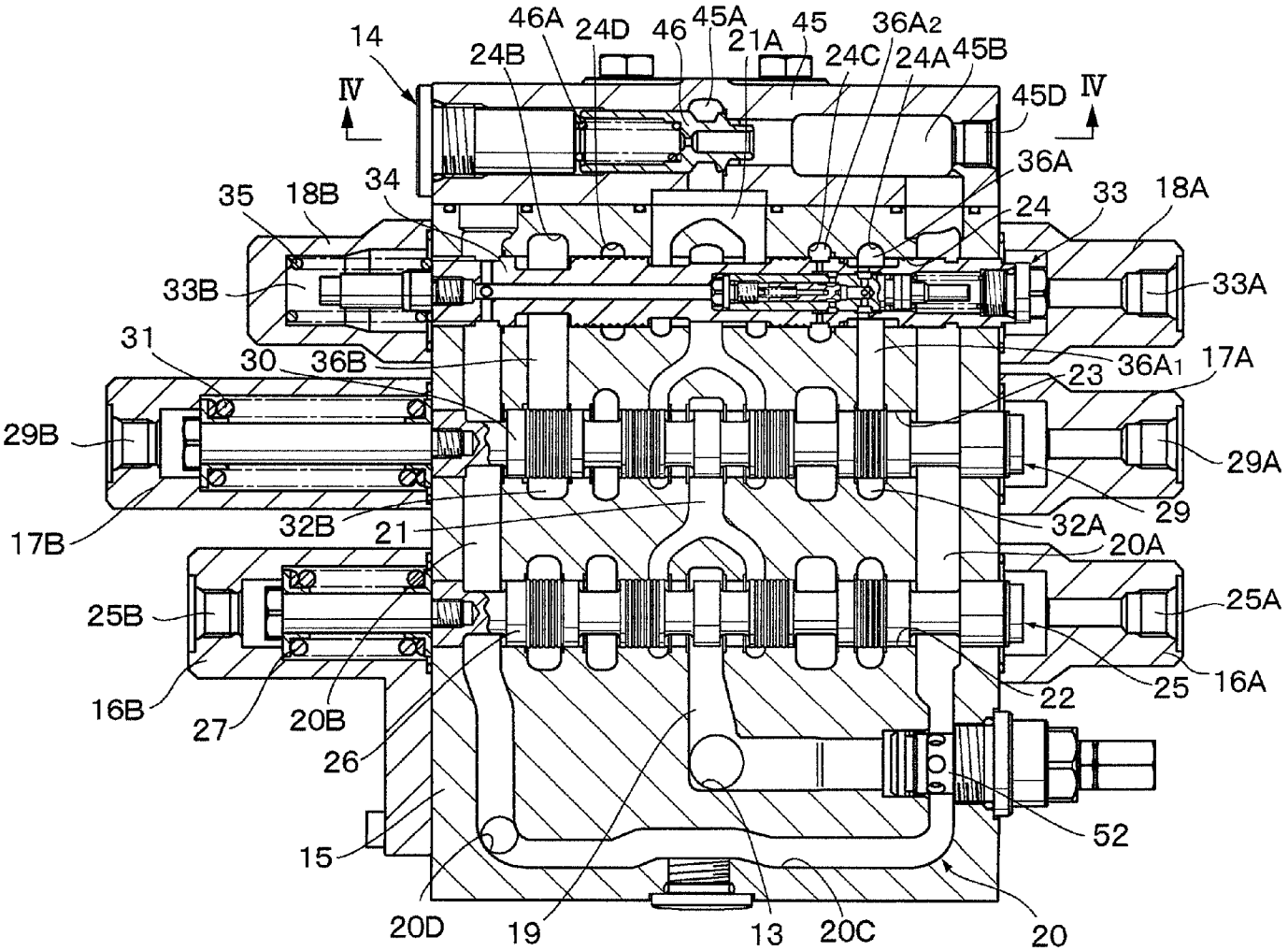
FIG. 3 is a longitudinal cross-sectional view showing a multiple valve device in FIG. 2 in enlarged form.

Designated at 14 is a multiple valve device adopted in the first embodiment, and the multiple valve device 14 is provided between the hydraulic pump 10, the tank 11 and the hydraulic actuator (for example, the pair of the left and right boom cylinders 7C and the bucket cylinder 7D). As shown in FIG. 3, the multiple valve device 14 comprises a valve housing 15 and a valve block 45 to be described later. The valve housing 15 accommodates therein a bucket control valve 25, a boom control valve 29, and a pulsation absorption control valve 33, which will be described later, provided in a parallel arrangement in such a manner as to extend in parallel with each other on the same plane.

The valve housing 15 of the multiple valve device 14 is molded as a block body (cast metal) having a cubic shape by using casting means, for example. A cover member 16A and a cover member 16B are removably mounted to both the left and right sides of the valve housing 15 in positions corresponding to a spool sliding bore 22 to be described later, a cover member 17A and a cover member 17B are removably mounted in positions corresponding to a spool sliding bore 23, and further, a cover member 18A and a cover member 18B are removably mounted in positions corresponding to a spool sliding bore 24.

Figure 2:
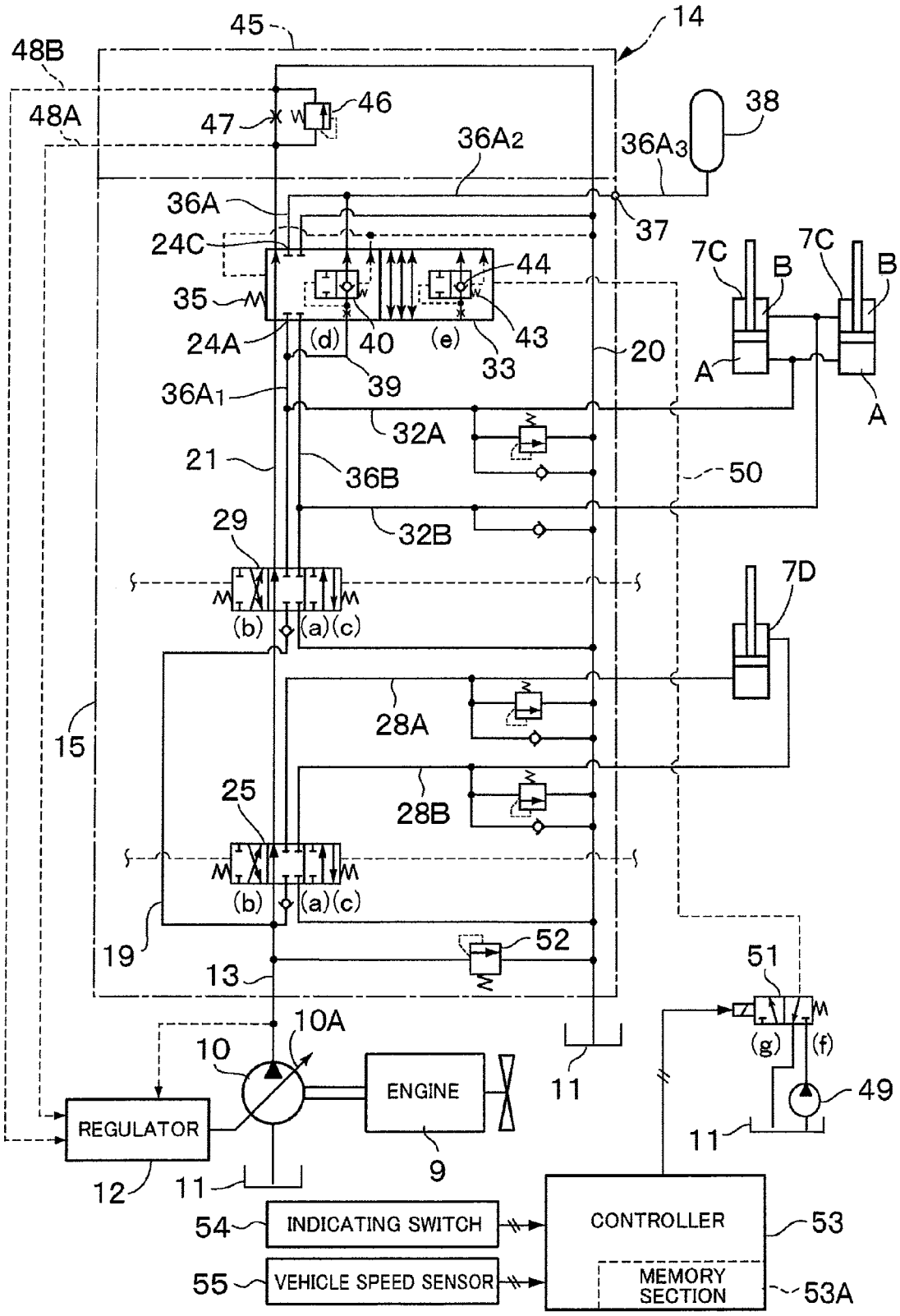
FIG. 2 is a circuit construction diagram showing a hydraulic circuit in the hydraulic control device according to the first embodiment.

Indicated at 19 is the supply line of pressurized oil provided in the valve housing 15, and the supply line 19 is, as shown in FIG. 2, provided to be connected to the front end side of the discharge line 13. The bucket control valve 25 and the boom control valve 29 are connected in parallel in such a manner as to be in parallel with the hydraulic pump 10 by the supply line 19. It should be noted that in FIG. 3, a section of the parallel connection by the supply line 19 is not illustrated.

Indicated at 20 is a return line provided in the valve housing 15, and as shown in FIG. 3, the return line 20 is formed as a passage having a U-letter shape as a whole. That is, the return line 20 is constituted by including side passages 20A and 20B spaced largely in the right-left direction from each other and a lower passage 20C for regularly establishing communication between the side passages 20A and 20B in the lower side.

The side passages 20A and 20B of the return line 20 extend in a direction perpendicular (intersecting) to sections in axial both sides of each of the spool sliding bores 22 to 24 to be described later. Return oil is discharged to these side passages 20A and 20B from the oil groove sides of the spool sliding bores 22 to 24 when spools 26, 30, and 34, which will be described later, slide and are displaced axially. The return oil introduced into the return line 20 is discharged in such a manner as to be circulated from the side of an oil passage hole 20D shown in FIG. 3 to the tank 11.

Indicated at 21 is the center bypass line provided in the valve housing 15, and, as shown in FIG. 2 and FIG. 3, the center bypass line 21 has one end connected to the supply line 19 in the front end side of the discharge line 13 and the other end connected to the return line 20 in a position downstream of the valve block 45 to be described later. The downstream side of the center bypass line 21 is formed as a connecting port 21A open to an upper end surface of the valve housing 15, for example, and the connecting port 21A is communicated with an oil passage 45B in a valve block 45 to be described later.

The center bypass line 21 connects the hydraulic pump 10 to the tank 11 to circulate the pressurized oil to the side of the return line 20 while the bucket control valve 25 and the boom control valve 29 both, to be described later, are in a neutral position (a). When at least one of the bucket control valve 25 and the boom control valve 29 is switched from the neutral position (a) to a switching position (b) or (c), the circulation of the pressurized oil via the center bypass line 21 is blocked off.

Indicated at 22, 23, and 24 are a plurality (for example, three) of spool sliding bores provided in the valve housing 15, and the spool sliding bores 22 to 24 are, as shown in FIG. 3, arranged in such a manner as to be spaced from each other on the same plane and extend in parallel in the right-left direction. That is, the spool sliding bores 22 to 24 are arranged to be spaced from each other in the length direction of the center bypass line 21 and the respective bores are disposed to extend in parallel in a direction crossing halfway sections of the center bypass line 21 (that is, a direction intersecting with the center bypass line 21).

Here, the spool sliding bore 22 of the spool sliding bores 22 to 24 positioned in the lowest side in the height direction has both of left and right sides closed by the cover members 16A and 16B. The spool sliding bore 23 of the spool sliding bores 22 to 24 positioned in the intermediate side in the height direction has both sides closed by the cover members 17A and 17B. The spool sliding bore 24 of the spool sliding bores 22 to 24 positioned in the most upper side in the height direction has both sides closed by the cover members 18A and 18B. It should be noted that, as shown in FIG. 3, the valve housing 15 in the multiple valve device 14 is not limited to the arrangement where the spool sliding bores 22 to 24 are vertically spaced in a longitudinal array. For example, the spool sliding bores 22 to 24 may be arranged in a horizontal array in such a manner as to be spaced from each other in the front-rear direction.

Figure 5:
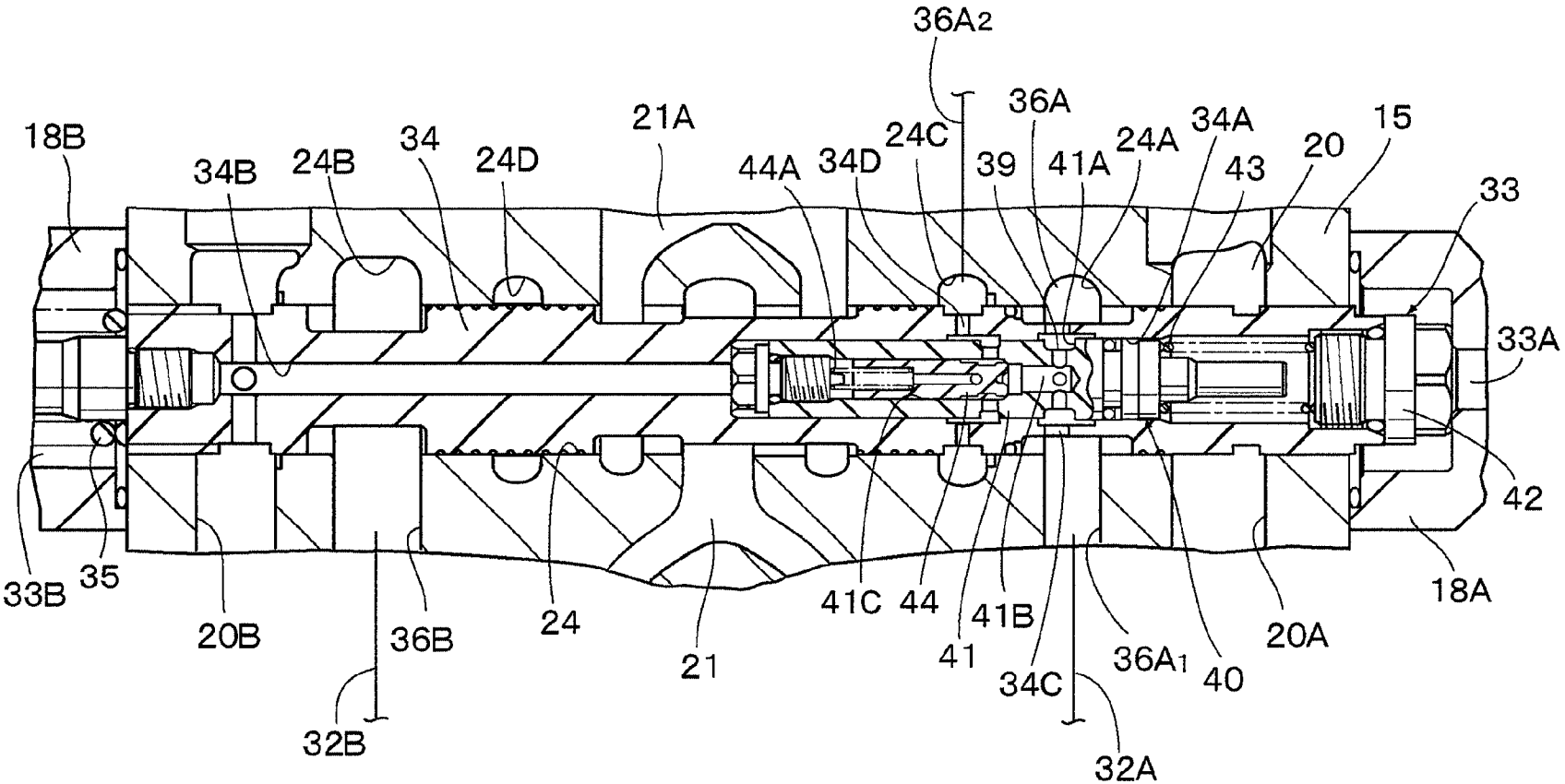
FIG. 5 is a longitudinal cross-sectional view showing a pulsation absorption control valve in FIG. 3 in enlarged form.
Figure 6:
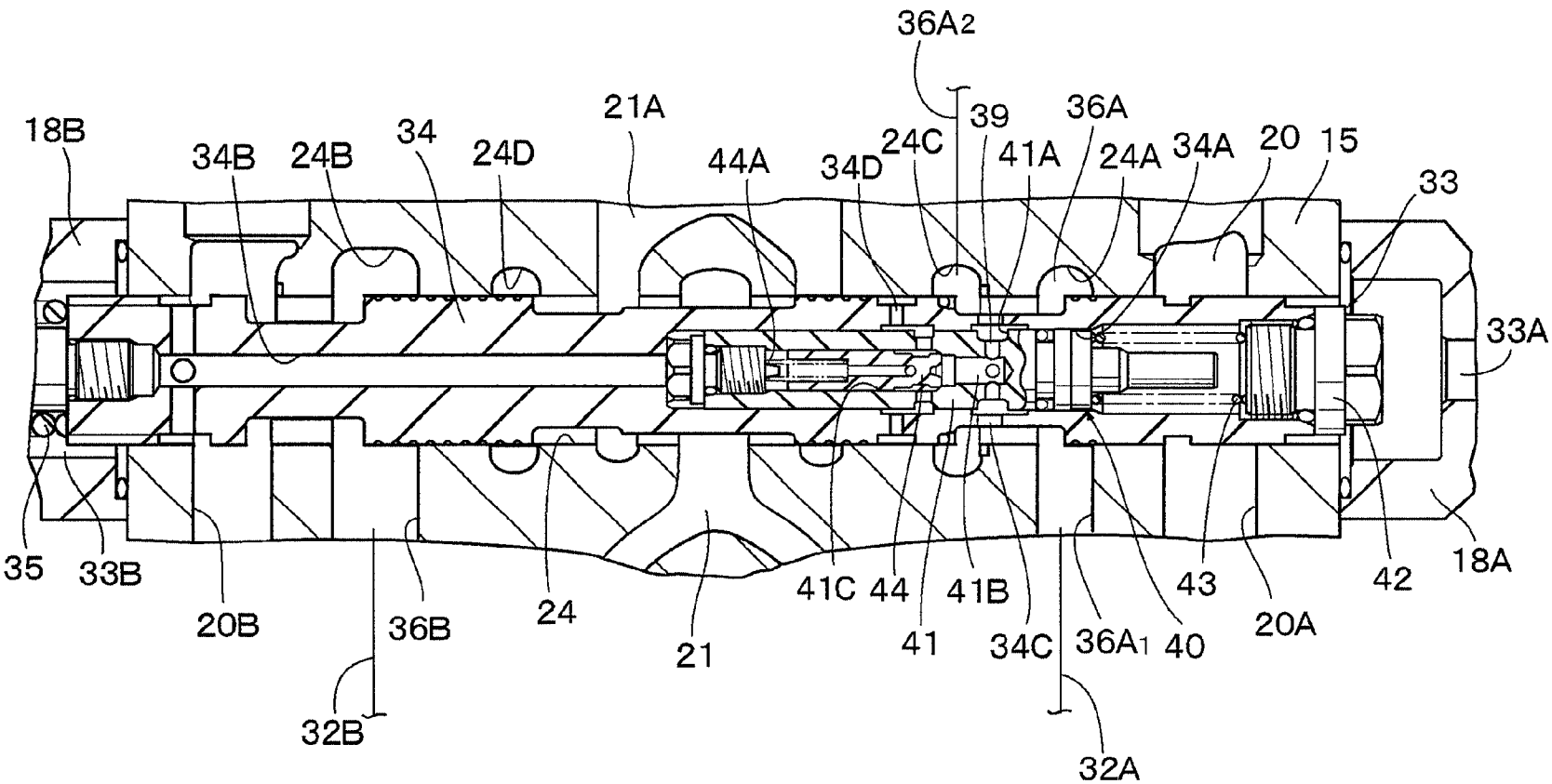
FIG. 6 is a longitudinal cross-sectional view showing a state where the pulsation absorption control valve is switched to an operating position in the same position as in FIG. 5.

Here, as shown in FIG. 3, FIG. 5 and FIG. 6, in the valve housing 15, annular oil grooves 24A and 24B are formed on a peripheral wall side of the spool sliding bore 24 to be axially (right-left direction) spaced. The oil grooves 24A and 24B are arranged in positions at the axial inner side of the spool sliding bore 24 than the side passages 20A and 20B of the return line 20. In addition, the other annular oil grooves 24C and 24D are formed between the oil grooves 24A and 24B in such a manner as to sandwich the center bypass line 21 therebetween in the right-left direction.

The oil grooves 24A and 24C out of these oil grooves 24A to 24D constitute a part of the one communication line 36A connected to the main line 32A to be described later, and the other oil groove 24B constitutes apart of the other communication line 36B connected to the main line 32B to be described later. It should be noted that an annular oil groove is formed on the peripheral wall side of each of the spool sliding bores 22 and 23 in substantially the same way as the spool sliding bore 24.

Designated at 25 is the directional control valve for the bucket cylinder 7D (hereinafter, called a bucket control valve 25) provided in the valve housing 15. The bucket control valve 25 is constituted by a spool valve in which a spool 26 is inserted and fitted into the spool sliding bore 22. The bucket control valve 25 includes hydraulic pilot portions 25A and 25B formed in the cover members 16A and 16B to be positioned in axial both sides of the spool 26. A spring 27 is arranged in the left hydraulic pilot portion 25B for urging the spool 26 toward the neutral position (a) regularly.

Here, the spool 26 in the bucket control valve 25 axially slides and is displaced in the spool sliding bore 22 according to a pilot pressure supplied to the hydraulic pilot portions 25A and 25B from an operating valve (not shown) provided in an operating lever for working. Therefore, the bucket control valve 25 is switched to the left or right switching position (b) or (c) from the neutral position (a) in FIG. 2.

Indicated at 28A and 28B are main lines for bucket cylinder provided between the bucket control valve 25 and the bucket cylinder 7D. The main lines 28A and 28B supply/discharge pressurized oil from the supply line 19 to/from the bucket cylinder 7D to drive the bucket cylinder 7D in a contraction direction when the bucket control valve 25 is switched from the neutral position (a) as shown in FIG. 2 to the switching position (b). On the other hand, the bucket cylinder 7D is driven in an expansion direction when the bucket control valve 25 is switched from the neutral position (a) as shown in FIG. 2 to the switching position (c).

Designated at 29 is the directional control valve for the boom cylinder 7C (hereinafter, called a boom control valve 29) provided in the valve housing 15. The boom control valve 29 is constituted by a spool valve in which a spool 30 is inserted and fitted into the spool sliding bore 23. The boom control valve 29 includes hydraulic pilot portions 29A and 29B formed in the cover members 17A and 17B to be positioned in axial both sides of the spool 30. A spring 31 is arranged in the left hydraulic pilot portion 29B for urging the spool 30 toward the neutral position (a) regularly.

Here, the spool 30 in the boom control valve 29 axially slides and is displaced in the spool sliding bore 23 according to a pilot pressure supplied to the hydraulic pilot portions 29A and 29B from the operating valve (not shown) provided in the operating lever for working. Therefore, the boom control valve 29 is switched to the left or right switching position (b) or (c) from the neutral position (a) in FIG. 2.

Indicated at 32A and 32B are the main lines for the boom cylinder provided between the boom control valve 29 and the boom cylinder 7C. The main line 32A which is one of the main lines 32A and 32B is connected to a bottom-side oil chamber A of the boom cylinder 7C constituting the hydraulic actuator, and the other main line 32B is connected to a rod-side oil chamber B of the boom cylinder 7C.

When the boom control valve 29 is switched from the neutral position (a) as shown in FIG. 2 to the switching position (b), the pressurized oil from the supply line 19 is supplied via the main line 32B to the rod-side oil chamber B of the boom cylinder 7C. At this time, the return oil is discharged via the main line 32A from the bottom-side oil chamber A of the boom cylinder 7C to the side of the return line 20. Therefore, the boom cylinder 7C is driven in the contraction direction.

When the boom control valve 29 is switched from the neutral position (a) as shown in FIG. 2 to the switching position (c), the pressurized oil from the supply line 19 is supplied via the main line 32A to the bottom-side oil chamber A of the boom cylinder 7C. At this time, the return oil is discharged via the main line 32B from the rod-side oil chamber B of the boom cylinder 7C to the side of the return line 20. Therefore, the boom cylinder 7C is driven in the expansion direction.

Next, a pulsation absorption control valve 33 used in the first embodiment will be explained.

That is, designated at 33 is the pulsation absorption control valve provided in the valve housing 15. The pulsation absorption control valve 33 is provided in the halfway section of the center bypass line 21 to be adjacent to the boom control valve 29 in a position downstream of the boom control valve 29. The pulsation absorption control valve 33 is constituted by a spool valve in which a spool 34 is inserted and fitted into the spool sliding bore 24. The pulsation absorption control valve 33 includes a hydraulic pilot portion 33A and a spring chamber 33B formed in the cover members 18A and 18B to be positioned in axial both sides of the spool 34. A spring 35 is arranged in the spring chamber 33B for urging the spool 34 toward the blockade position (d).

The pulsation absorption control valve 33 is usually displaced in the blockade position (d) shown in FIG. 2 by axially urging the spool 34 with the spring 35. In the blockade position (d), the communication between the bottom-side oil chamber A in the boom cylinder 7C and the accumulator 38 to be described later is blocked in the halfway position of the communication line 36A. The pulsation absorption control valve 33 is switched from the blockade position (d) shown in FIG. 2 to a communication position (e) when a pilot pressure is supplied from a pilot line 50 to be described later to the hydraulic pilot portion 33A. In the communication position (e), the communication between the bottom-side oil chamber A and the accumulator 38 is established via the communication line 36A to be described later.

As shown in FIG. 5 and FIG. 6, a valve sliding bore 34A composed of a stepped bore extending in an axial direction and an elongated oil passage 34B for drain are formed in the spool 34 of the pulsation absorption control valve 33. The valve sliding bore 34A of the spool 34 constitutes apart of a switching valve 40 to be described later. In other words, the pulsation absorption control valve 33 accommodates the switching valve 40 within the valve sliding bore 34A of the spool 34.

Radial oil passage holes 34C and 34D are formed in the spool 34 to be spaced from each other in an axial direction of the valve sliding bore 34A. These oil passage holes 34C and 34D constitute a part of a bypass passage 39 to be described later. The oil passage hole 34C which is one of them supplies pressurized oil into a valve body 41 of the switching valve 40 to be described later from the outside toward the inside in the radial direction. The oil passage hole 34D which is the other of them serves for pressurized oil to flow toward the side of the accumulator 38 at the opening of the check valve 44 to be described later.

Indicated at 36A and 36B are communication lines a halfway section of each of which is communicated or blocked by the pulsation absorption control valve 33, and one communication line 36A out of the communication lines 36A and 36B is provided between the accumulator 38 to be described later and the main line 32A for the boom cylinder 7C. The one communication line 36A constitutes a line for connecting the bottom-side oil chamber A in the boom cylinder 7C constituting the hydraulic actuator to the accumulator 38. The other communication line 36B is provided between the return line 20 and the main line 32B for the boom cylinder 7C, and constitutes a line for connecting the main line 32B to the side of the tank 11, that is, the side passage 20B of the return line 20.

As shown in FIG. 3, the one communication line 36A is constituted by a first line section 36A1 for establishing communication between the oil groove 24A in the spool sliding bore 24 and the main line 32A, a second line section 36A2 having one side connected to the oil groove 24C in the spool sliding bore 24 and the other side communicated with a connecting point 37 (refer to FIG. 2) open to an outside surface of the valve housing 15, and a third line section 36A3 for removably connecting the accumulator 38, which will be described later, to the connecting point 37.

The first and second line sections 36A1 and 36A2 out of the one communication line 36A are constituted by an oil passage extending inside the valve housing 15. The third line section 36A3 is constituted by hydraulic pipes, hoses and the like provided outside of the valve housing 15. Among them, the first line section 36A1 is composed of a passage linearly extending between the spool sliding bore 23 in the boom control valve 29 and the spool sliding bore 24 in the pulsation absorption control valve 33, and is formed to extend in parallel with the side passage 20A in the return line 20.

In regard to the one communication line 36A, when the spool 34 in the pulsation absorption control valve 33 slides and is displaced in the spool sliding bore 24, the communication between the first and second line sections 36A1 and 36A2 (that is, between the oil grooves 24A and 24C) is established or blocked off. As a result, the accumulator 38 to be described later is communicated with or blocked off from the main line 32A and the bottom-side oil chamber A in the boom cylinder 7C via the one communication line 36A.

The other communication line 36B is arranged in a position opposite to the first line section 36A1 in the one communication line 36A by interposing the center bypass line 21 therebetween. The other communication line 36B is constituted by a linear oil passage for communicating the oil groove 24B in the spool sliding bore 24 with the main line 32A. That is, the other communication line 36B is formed as a passage linearly extending in parallel with the side passage 20B in the return line 20 between the spool sliding bores 23 and 24 in the valve housing 15.

In regard to the other communication line 36B, when the spool 34 in the pulsation absorption control valve 33 slides and is displaced in the spool sliding bore 24, the communication of the side of the oil groove 24B with the side passage 20B in the return line 20 is established or blocked off. As a result, the main line 32B and the bottom-side oil chamber A in the boom cylinder 7C is communicated with or blocked off from the side of tank 11 via the other communication line 36B.

Here, the first line section 36A1 of the communication line 36A and the other communication line 36B are formed as a linear passage extending in parallel with each other between the spool sliding bore 23 in the boom control valve 29 and the spool sliding bore 24 in the pulsation absorption control valve 33. The first line section 36A1 of the communication line 36A and the other communication line 36B are arranged in positions spaced from each other in the right-left direction (that is, positions spaced in the axial direction of the spool sliding bores 23 and 24) by interposing the center bypass line 21 therebetween.

Indicated at 38 is the accumulator for pulsation absorption constituting a dynamic damper, and the accumulator 38 is connected via the one communication line 36A and the main line 32A to the bottom-side oil chamber A in the boom cylinder 7C. The accumulator 38 absorbs pressure pulsations generated in the bottom-side oil chamber A at the traveling of the vehicle. That is, when the loader bucket 7B in the working mechanism 7 is vibrated following the traveling of the wheel loader 1, the vibration is transmitted via the boom 7A to the boom cylinder 7C. Therefore, the pressure pulsation is generated in each of the bottom-side oil chamber A in the boom cylinder 7C and the main line 32A.

Therefore, when the pulsation absorption control valve 33 is switched from a blockade position (d) as shown in FIG. 2 to a communication position (e), the accumulator 38 is communicated with the bottom-side oil chamber A in the boom cylinder 7C via the communication line 36A and the main line 32A. In consequence, the accumulator 38 serves as the dynamic damper to absorb the pressure pulsation generated in the bottom-side oil chamber A.

Designated at 39 is the bypass passage provided in the spool 34 in the pulsation absorption control valve 33, and the bypass passage 39 is constituted by a valve sliding bore 34A, oil passage holes 34C and 34D, and an oil passage 41B to be described later, which are formed in the spool 34. In addition, the bypass passage 39 establishes communication between the bottom-side oil chamber A in the boom cylinder 7C and the accumulator 38 via a check valve 44 to be described later even when the pulsation absorption control valve 33 is positioned in any of the blockade position (d) and the communication position (e).

Designated at 40 is the switching valve provided inside the pulsation absorption control valve 33, and the switching valve 40 is constituted by including a valve body 41 composed of a spool which is inserted and fitted into the valve sliding bore 34A in the spool 34, a plug 42 for covering the valve sliding bore 34A in the spool 34 at the right end section, and a spring 43 arranged between the plug 42 and the valve body 41 for urging the valve body 41 toward the left direction in FIG. 5.

The valve body 41 of the switching valve 40 is provided with an annular pressure receiving surface 41A formed in a position facing the oil passage hole 34C in the spool 34, an oil passage 41B constituting a part of the bypass passage 39 for introducing pressurized oil in the side of the oil passage hole 34C to the side of the oil passage hole 34D, and a valve accommodating bore 41C positioned in the halfway point of the oil passage 41B for accommodating therein the check valve 44 to be described later. The switching valve 40 accommodates the check valve 44 inside the valve accommodating bore 41C.

The valve body 41 of the switching valve 40 receives a pressure in the side of the first line section 36A1 in the one communication line 36A on the annular pressure receiving surface 41A, and, when this pressure exceeds a predetermined set pressure (urging force of the spring 43), slides and is displaced in a valve closing direction (right direction in FIG. 5) against the spring 43. Therefore, the oil passage hole 34C of the spool 34 is blocked off from the oil passage 41B of the valve body 41, and the communication between the boom cylinder 7C and the accumulator 38 by the bypass passage 39 is blocked off. That is, even at the opening of the check valve 44 to be described later, the bypass passage 39 is placed in the blockade state.

Indicated at 44 is the check valve provided inside the switching valve 40, and the check valve 44 is slidably provided in the oil passage 41B in the valve body 41, and is regularly held in a valve closing state by a weak spring 44A. In addition, the check valve 44 allows pressurized oil to flow in one direction of the bypass passage 39 (from the side of the oil passage hole 34C to the side of the oil passage hole 34D) and blocks a flow of pressurized oil toward the other direction as a reverse direction (from the side of the oil passage hole 34D to the side of the oil passage hole 34C).

Indicated at 45 is the valve block provided to overlap over the valve housing 15, and the valve block 45 is provided with an annular oil chamber 45A communicated with the connecting port 21A of the center bypass line 21 formed in the valve housing 15 to make a relief valve 46 to be described later receive the upstream pressure and an oil passage 45B communicated with the side of the annular oil chamber 45A at the opening of the relief valve 46, which are formed therein. The downstream side of the oil passage 45B is communicated with the side passage 20A of the return line 20.

Figure 4:
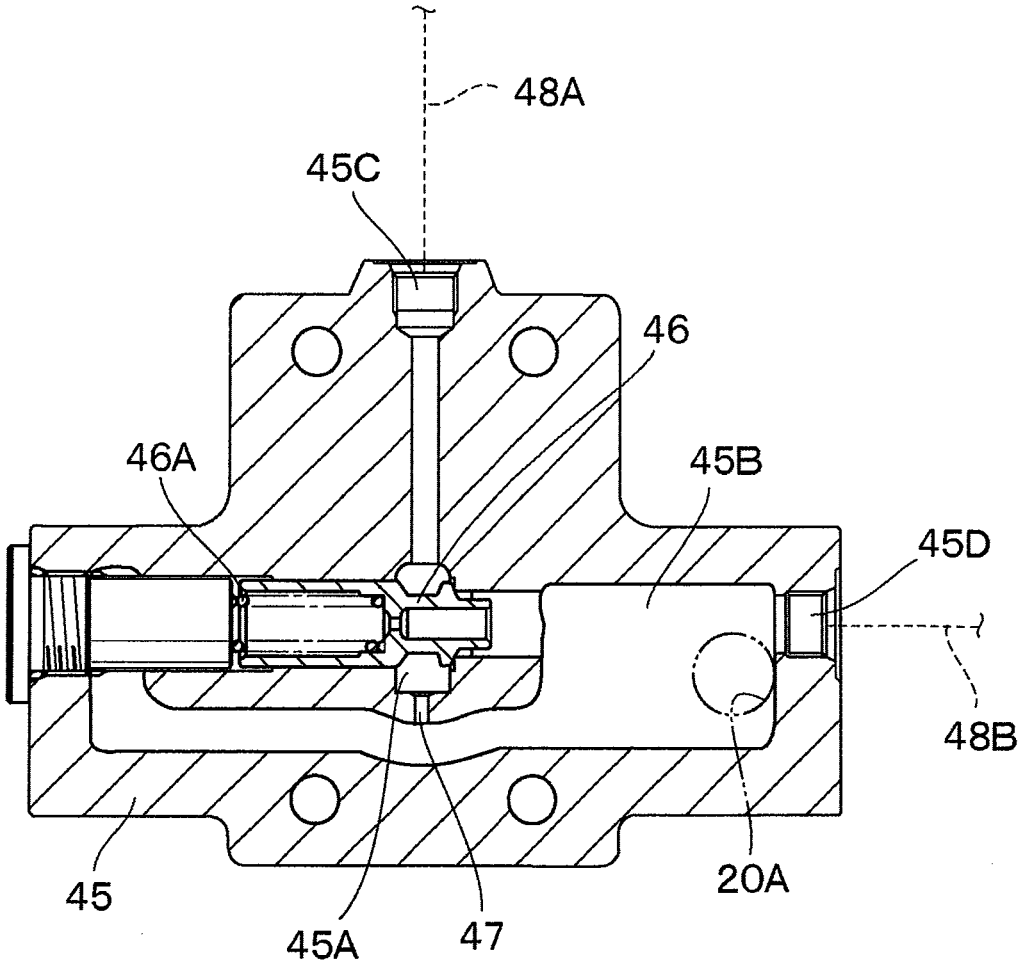
FIG. 4 is a cross-sectional view showing a relief valve and a throttle provided in a valve block in the multiple valve device as viewed in the direction of arrows IV-IV in FIG. 3.

As shown in FIG. 4, the valve block 45 is provided with a throttle 47 to be described later to constitute a parallel circuit with the relief valve 46. The valve block 45 is provided with a first connecting port 45C communicated with the side of the annular oil chamber 45A and a second connecting port 45D communicated with the side of the oil passage 45B. A control line 48A to be described later is connected to the first connecting port 45C, and a control line 48B to be described later is connected to the second connecting port 45D.

Indicated at 46 is a relief valve provided in the valve block 45. The relief valve 46 has a pressure setting spring 46A, and a relief pressure is in advance determined by the pressure setting spring 46A. The relief valve 46 receives a pressure of pressurized oil flowing in the center bypass line 21 at the side of the annular oil chamber 45A. When the pressure in the annular oil chamber 45A exceeds a set pressure by the pressure setting spring 46A, the relief valve 46 opens and functions for the excessive pressure at this time to flow from the side of the oil passage 45B to the side of the side passage 20A in the return line 20, thus achieving a relief function.

Indicated at 47 is the throttle provided in the valve block 45 in parallel with the relief valve 46, and the throttle 47 is formed as a throttle bore for establishing communication between the annular oil chamber 45A and the oil passage 45B in the valve block 45 by bypassing the relief valve 46. The throttle 47 applies a throttling function to pressurized oil flowing in the center bypass line 21, that is, pressurized oil flowing from the annular oil chamber 45A of the valve block 45 toward the oil passage 45B. Thereby, a differential pressure between upstream and downstream of the throttle 47 is generated.

Indicated at 48A and 48B are a pair of control lines, and the control lines 48A and 48B are connected to the first and second connecting ports 45C and 45D provided in the valve block 45. The control lines 48A and 48B are arranged to be communicated with positions before and after the throttle 47. Therefore, the differential pressure between upstream and downstream of the throttle 47 is supplied as a control pressure for negative control via the control lines 48A and 48B to the regulator 12. As a result, the regulator 12 drives the displacement variable portion 10A in the hydraulic pump 10 according to the control pressure and variably controls a discharge volume (displacement) of the hydraulic pump 10 in such a manner that the differential pressure is within a predetermined pressure range.

Indicated at 49 is a pilot pump which constitutes a sub hydraulic source together with the tank 11, and the pilot pump 49 is driven and rotated together with the main hydraulic pump 10 by the engine 9. The pilot pump 49 discharges operating oil suctioned from the tank 11 into the pilot line 50 to generate a pilot pressure to be described later.

Indicated at 51 is the remote control valve operable to switch the pulsation absorption control valve 33, and the remote control valve 51 is constituted by an electromagnetic valve and is switched from a stop position (f) to an operating position (g) in response to a switching signal outputted from a controller 53 to be described later. While the remote control valve 51 is in the stop position (f), the pulsation absorption control valve 33 is held in a blockade position (d) by the spring 35.

On the other hand, when the remote control valve 51 is switched from the stop position (f) to the operating position (g), a pilot pressure is supplied to the hydraulic pilot portion 33A of the pulsation absorption control valve 33 from the pilot line 50. In consequence, the pulsation absorption control valve 33 is switched from the blockade position (d) shown in FIG. 2 to a communication position (e) against the spring 35.

Indicated at 52 is a main relief valve for setting the maximum discharge pressure of the hydraulic pump 10. As shown in FIG. 2, the main relief valve 52 constitutes a high-pressure relief valve and is provided between the discharge line 13 and the return line 20. The main relief valve 52 sets the maximum discharge pressure of pressurized oil by the main hydraulic pump 10 to relieve an excessive pressure more than the maximum discharge pressure to the side of the tank 11.

Designated at 53 is the controller as control means composed of a microcomputer and the like, and the controller 53 has an input side connected to an indicating switch 54 of the dynamic damper and a vehicle speed sensor 55 and an output side connected to the remote control valve 51. The controller 53 has a memory section 53A including a ROM, a RAM, a nonvolatile memory and the like, and a switching processing program for the remote control valve 51 shown in FIG. 7 to be described later is stored in the memory section 53A.

The indicating switch 54 of the dynamic damper, for example, when an operator in the cab 8 performs an operation of a traveling lever (not shown) for driving and traveling the wheel loader 1, outputs an indication signal following the operation to the controller 53. The controller 53 determines whether or not the wheel loader 1 is in travel according to the signal from the indicating switch 54.

The vehicle speed sensor 55 detects a traveling speed of the wheel loader 1 and outputs the detection signal to the controller 53. The controller 53 determines whether or not the traveling speed (vehicle speed) of the wheel loader 1 is within a prescribed range according to the detection signal from the vehicle speed sensor 55, that is, whether or not the traveling speed is a vehicle speed in which the accumulator 38 should be operated as the dynamic damper.

The hydraulic control device of the wheel loader 1 according to the first embodiment is constituted as described above, and next, an operation thereof will be explained.

When the engine 9 is activated in a state where an operator of the wheel loader 1 boards on the cab 8 of the vehicle body 2, the hydraulic pump 10 and the pilot pump 49 are driven and rotated by the engine 9. In consequence, pressurized oil is discharged from the hydraulic pump 10 toward the discharge line 13, the supply line 19, and the center bypass line 21.

While the bucket control valve 25 and the boom control valve 29 both are in the neutral position (a), the hydraulic pump 10 and the tank 11 are connected by the center bypass line 21. Therefore, the pressurized oil flowing in the center bypass line 21 is circulated through the return line 20 to the tank 11. At this time, the throttle 47 in the valve block 45 applies a throttling function to the pressurized oil flowing in the center bypass line 21 to generate a differential pressure between upstream and downstream of the throttle 47. The differential pressure at this time increases when a flow amount of the pressurized oil flowing in the throttle 47 is large, and decreases when small.

Therefore, the regulator 12 drives the displacement variable portion 10A of the hydraulic pump 10 according to a control pressure (differential pressure by the throttle 47) for negative control supplied via the control lines 48A and 48B. As a result, the displacement variable portion 10A variably controls a flow amount of the pressurized oil discharged from the hydraulic pump 10 in such a manner that the differential pressure is within a predetermined pressure range.

That is, when the differential pressure between upstream and downstream of the throttle 47 is large, the regulator 12 drives the displacement variable portion 10A in the hydraulic pump 10 to the side of the small flow amount in such a manner as to reduce a flow amount of the pressurized oil discharged from the hydraulic pump 10. On the other hand, when the differential pressure between upstream and downstream of the orifice 47 is small, the regulator 12 drives the displacement variable portion 10A in the hydraulic pump 10 to the side of the large flow amount in such a manner as to increase a flow amount of the pressurized oil discharged from the hydraulic pump 10. Therefore, a flow amount of the pressurized oil wastefully discharged via the center bypass line 21 from the hydraulic pump 10 to the tank 11 can be reduced to achieve the energy saving.

Next, when an operator in the cab 8 performs an operating lever for working, the bucket control valve 25 is switched from the neutral position (a) to any of the switching positions (b) and (c). Therefore, the pressurized oil from the supply line 19 is supplied to or discharged from the bucket cylinder 7D via the main lines 28A and 28B and the loader bucket 7B in the working mechanism 7 is turned by the bucket cylinder 7D. On the other hand, when the boom control valve 29 is switched from the neutral position (a) to any of the switching positions (b) and (c), the pressurized oil from the supply line 19 is supplied to or discharged from the boom cylinder 7C via the main lines 32A and 32B and the boom 7A is vertically raised/lowered by the boom cylinder 7C. In this way, the working mechanism 7 can perform an excavating operation or a shoveling operation of earth and sand by operating the boom 7A and the loader bucket 7B.

The pulsation absorption control valve 33 is held in the blockade position (d) shown in FIG. 2 at the working of the working mechanism 7. Thereby, the pulsation absorption control valve 33 blocks the accumulator 38 in the halfway point of the one communication line 36A to the main line 32A and blocks the main line 32B in the halfway position of the other communication line 36B to the return line 20 and the tank 11. Accordingly, the bottom-side oil chamber A of the boom cylinder 7C is not communicated with the accumulator 38 and the rod-side oil chamber B is not communicated with the side of the tank 11.

However, the pulsation absorption control valve 33 is provided with the bypass passage 39 composed of the valve sliding bore 34A, the oil passage holes 34C and 34D, and the oil passage 41B, which are formed in the spool 34. The bypass passage 39 is provided with the switching valve 40 and the check valve 44. Therefore, when a pressure in the accumulator 38 is lower than a pressure in the side of the main line 32A, the check valve 44 opens to be capable of resupplying the pressure (pressurized oil) in the side of the main line 32A into the accumulator 38.

Meanwhile, when the pressure in the side of the main line 32A (first line section 36A1 of the communication line 36A) exceeds a predetermined set pressure by the spring 43, the valve body 41 of the switching valve 40 moves in a valve closing direction against the spring 43. Therefore, the bypass passage 39 is blocked off by the valve body 41 of the switching valve 40 and therefore, the communication between the main line 32A (bottom-side oil chamber A) in the boom cylinder 7C and the accumulator 38 is blocked off. As a result, the pressure in the accumulator 38 can be prevented from reaching an excessive pressure exceeding the set pressure. Further, the check valve 44 can block a reverse flow of the pressurized oil in the accumulator 38 via the bypass passage 39 to the side of the main line 32A.

Next, when an operator in the cab 8 performs an operation of driving and traveling the wheel loader 1, the indicating switch 54 is closed following this operation to output the indication signal to the controller 53 from the indicating switch 54. Thereby, the controller 53 determines whether or not the wheel loader 1 is in travel according to the indication signal from the indicating switch 54.

Here, an explanation will be made of a switching control process of the remote control valve 51 by the controller 53 with reference to FIG. 7.

Figure 7:
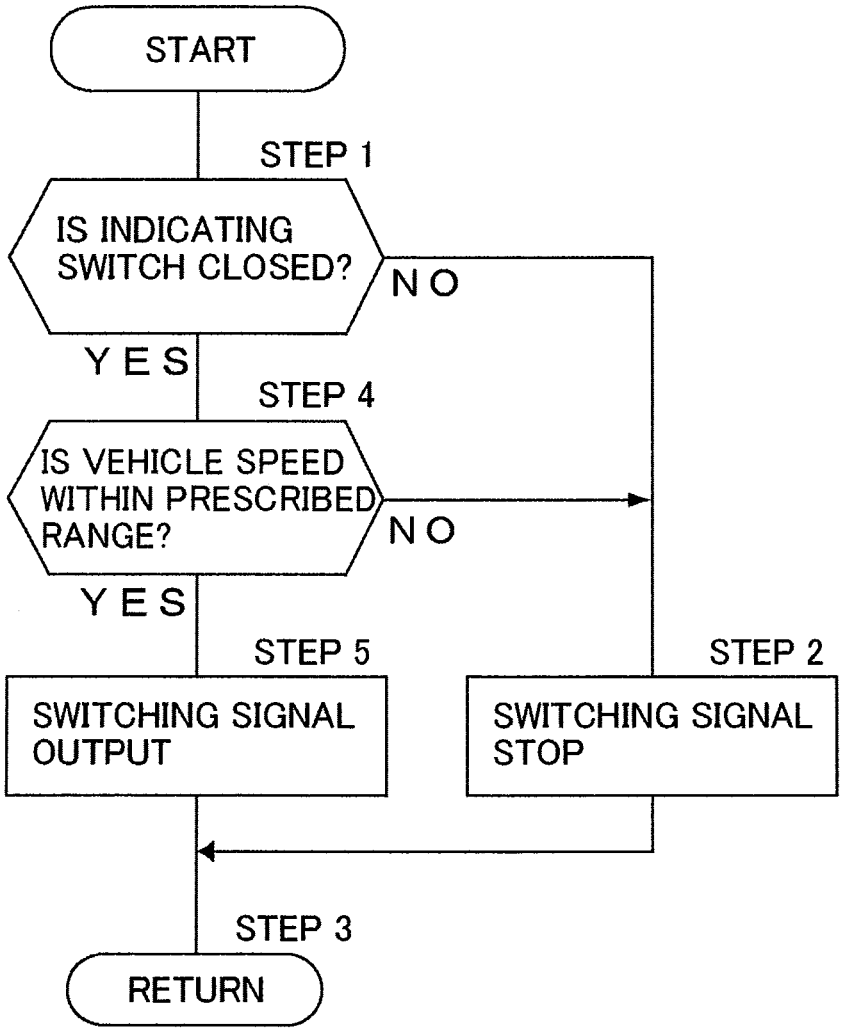
FIG. 7 is a flow chart showing a switching control process of a remote control valve by a controller in FIG. 2.

When the processing operation in FIG. 7 is started, at step 1, it is determined whether or not the indicating switch 54 for the dynamic damper is closed. While the determination of "NO" is made at step 1, it can be determined that the indicating switch 54 is opened and the wheel loader 1 is parked or stopped (including working time), and the process goes to step 2.

At next step 2, the output of the switching signal to the remote control valve 51 is stopped to hold the remote control valve 51 in the stop position (f) shown in FIG. 2. Therefore, the pilot pressure in the pilot line 50 is lowered to a level of the tank pressure, and the pulsation absorption control valve 33 is in a state of being held in the blockade position (d) by the spring 35, and the process goes to step 3.

However, when the determination of "YES" is made at step 1, it can be determined that the indicating switch 54 is closed and the wheel loader 1 is in travel, and the process goes to step 4. At next step 4, it is determined whether or not a traveling speed (vehicle speed) of the wheel loader 1 is within a prescribed range based upon a detection signal from the vehicle speed sensor 55. When the determination of "YES" is made at step 4, the vehicle speed of the wheel loader 1 can be determined as a vehicle speed in which the accumulator 38 should be operated as the dynamic damper, and the process goes to step 5. Therefore, at next step 5, a switching signal is outputted to the remote control valve 51 to switch the remote control valve 51 from the stop position (f) shown in FIG. 2 to the operating position (g).

Therefore, the pressurized oil from the pilot pump 49 is supplied as a pilot pressure into the pilot line 50, and the pulsation absorption control valve 33 is switched from the blockade position (d) to the communication position (e) against the spring 35. That is, the spool 34 in the pulsation absorption control valve 33 axially slides and is displaced in the spool sliding bore 24 by the pilot pressure supplied to the side of the hydraulic pilot portion 33A. Accordingly, the spool 34 moves from one stroke end shown in FIG. 5 to the other stroke end shown in FIG. 6.

Therefore, in regard to the one communication line 36A formed in the valve housing 15, the communication between the first and second line sections 36A1 and 36A2 (that is, between the oil grooves 24A and 24C) is established by the spool 34 in the pulsation absorption control valve 33. With regard to the other communication line 36B also, the communication of the side of the oil groove 24B with the side passage 20B in the return line 20 is established by the spool 34.

Therefore, the rod-side oil chamber B in the boom cylinder 7C is in a state of being communicated with the side of the tank 11 via the other communication line 36B, and the bottom-side oil chamber A in the boom cylinder 7C is in a state of being communicated with the accumulator 38 via the one communication line 36A. As a result, the accumulator 38 can be operated as the dynamic damper for absorbing pressure pulsations at the traveling of the vehicle.

That is, when the loader bucket 7B as the weight object vibrates vertically at the traveling of the wheel loader 1, the boom cylinder 7C repeats the telescopic motion following the vertical vibration. When the boom cylinder 7C thus repeats the telescopic motion, the pressure pulsation is generated in the main lines 32A and 32B by this influence. However, when the accumulator 38 is operated as the dynamic damper, the pressure pulsation can be absorbed to achieve the vibration reduction and an improvement on the ride comfort of the vehicle.

In this manner, according to the first embodiment, the boom control valve 29 and the pulsation absorption control valve 33 are provided in the halfway point of the center bypass line 21, and the pulsation absorption control valve 33 is arranged in a position downstream of the boom control valve 29. The pulsation absorption control valve 33 is switched to any of the blockade position (d) and the communication position (e) by the pilot pressure from the remote control valve 51. Therefore, the pulsation absorption control valve 33 can establish or block the communication of the one communication line 36A with the one main line 32A among the pair of the main lines 32A and 32B.

As a result, the communication of the bottom-side oil chamber A in the boom cylinder 7C with the accumulator 38 can be established or blocked at the traveling or the stopping of the vehicle to reduce the vibration or the pressure pulsation caused by the telescopic motion of the boom cylinder 7C. That is, the accumulator 38 can be operated as the dynamic damper for absorbing the pressure pulsation at the traveling of the vehicle.

In this case, in the valve housing 15 in the multiple valve device 14, the one communication line 36A and the other communication line 36B are arranged in positions spaced in the right-left direction by putting the center bypass line 21 therebetween (positions spaced in an axial direction of the spool sliding bores 23 and 24). Therefore, the one communication line 36A and the other communication line 36B formed in the valve housing 15 can be connected linearly to the pair of the main lines 32A and 32B by a short distance to simplify the shape and structure of each line.

In addition, in regard to the valve housing 15 of the multiple valve device 14, the bucket control valve 25, the boom control valve 29, and the pulsation absorption control valve 33 are arranged in parallel in such a manner as to extend in parallel with each other on the same plane. Therefore, the structure of the multiple valve device 14 can be downsized and formed in a compact way. Further, the bucket control valve 25, the boom control valve 29, and the pulsation absorption control valve 33 can be accommodated in a compact arrangement in the single valve housing 15 for assembly, improving operability at assembling.

Particularly, in regard to the valve housing 15, the boom control valve 29 and the pulsation absorption control valve 33 are arranged in parallel on the same plane, and the communication lines 36A and 36B can be linearly connected to the pair of the main lines 32A and 32B by a short distance. In consequence, pressure losses of the pressurized oil flowing in the one communication line 36A can be suppressed to be small between the bottom-side oil chamber A in the boom cylinder 7C and the accumulator 38. Further, the structure of each of the communication lines 36A and 36B can be simplified to achieve downsizing and space saving of the entire device.

On the other hand, the bypass passage 39 is provided between the bottom-side oil chamber A in the boom cylinder 7C and the accumulator 38, and the valve body 41 of the switching valve 40 is provided in the bypass passage 39. Therefore, for example, when the pressure in the side of the bottom-side oil chamber A in the boom cylinder 7C is increased to a pressure exceeding the set pressure of the accumulator 38, the communication via the bypass passage 39 between the bottom-side oil chamber A in the boom cylinder 7C and the accumulator 38 can be blocked off by the valve body 41 of the switching valve 40 to prevent the excessive pressure from exerting on the accumulator 38.

Further, the check valve 44 is provided in the halfway point of the bypass passage 39. Therefore, by circulating the pressurized oil from the side of the bottom-side oil chamber A in the boom cylinder 7C toward the accumulator 38, resupply of the pressurized oil to the accumulator 38 can be made. As a result, the check valve 44 can prevent the pressure in the accumulator 38 from being excessively decreased or excessively increased, thus stabilizing an operation of the accumulator 38.

Moreover, the switching valve 40 is provided in the spool 34 of the pulsation absorption control valve 33, and the check valve 44 is provided in the valve body 41 of the switching valve 40. Therefore, the switching valve 40 and the check valve 44 can be assembled in the spool 34 of the pulsation absorption control valve 33 in a compact way to further achieve downsizing and space saving of the device.

FIG. 8 to FIG. 12 show a hydraulic control device for a working vehicle according to a second embodiment of the present invention.

The feature of the second embodiment lies in the construction that a switching position for generating the hydraulic load in the pulsation absorption control valve is added. It should be noted that in the second embodiment, component elements that are identical to those in the foregoing first embodiment will be simply denoted by the same reference numerals to avoid repetitions of similar explanations.

In the figure, indicated at 60 is a hydraulic pump driven by the engine 9 for rotation, and the hydraulic pump 60 is constituted substantially in the same way with the hydraulic pump 10 described in the first embodiment. However, in the hydraulic pump 60 in this case, which is different from that of the first embodiment, the displacement control by the regulator 12 is not performed. Therefore, the hydraulic pump 60 is not necessarily a variable displacement type hydraulic pump, and, for example, may adopt a fixed displacement type hydraulic pump.

Designated at 61 is an exhaust gas purifying device attached in the exhaust side of the engine 9, and the exhaust gas purifying device 61 removes harmful substances contained in an exhaust gas in the engine 9 for purification. That is, the engine 9 composed of a diesel engine has a high efficiency and is superior in durability, but discharges harmful substances such as particulate matter (PM), nitrogen oxide (NOx), and carbon monoxide (CO) together with the exhaust gas.

Therefore, the exhaust gas purifying device 61 mounted in the side of the exhaust pipe in the engine 9 is constituted to include a particulate matter removing filter 61A which traps particulate matter (PM) for removal, and an oxidation catalyst (not shown) which oxidizes carbon monoxide (CO) and the like for removal. The particulate matter removing filter 61A traps particulate matter from the exhaust gas in the engine 9 and burns the trapped particulate matter for removal to perform purification of the exhaust gas. The particulate matter removing filter 61A performs regeneration of the filter by burning the trapped particulate matter as described above.

Designated at 62 is a multiple valve device adopted by the second embodiment, and the multiple valve device 62 is constituted to include a valve housing 63 and a passage block 71 to be described later substantially in the same way with the multiple valve device 14 described in the first embodiment. The valve housing 63 is constituted substantially in the same way with the valve housing 15 described in the first embodiment, in which the bucket control valve 25, the boom control valve 29, and a pulsation absorption control valve 67 to be described later are arranged in parallel in such a manner as to extend in parallel with each other on the same plane. In the valve housing 63, the discharge line 13, the supply line 19, the return line 20, and the like are formed substantially in the same way with the valve housing 15 described in the first embodiment.

The cover members 16A and 16B are provided in both of left and right sides of the valve housing 63 to be positioned corresponding to the spool sliding bore 22 in the bucket control valve 25, and the cover members 17A and 17B are provided in positions corresponding to the spool sliding bore 23 in the boom control valve 29. However, cover members 64A and 64B for the pulsation absorption control valve 67 to be described later are removably provided in positions corresponding to both of the left and right sides of a spool sliding bore 66 of the pulsation absorption control valve 67.

Figure 9:
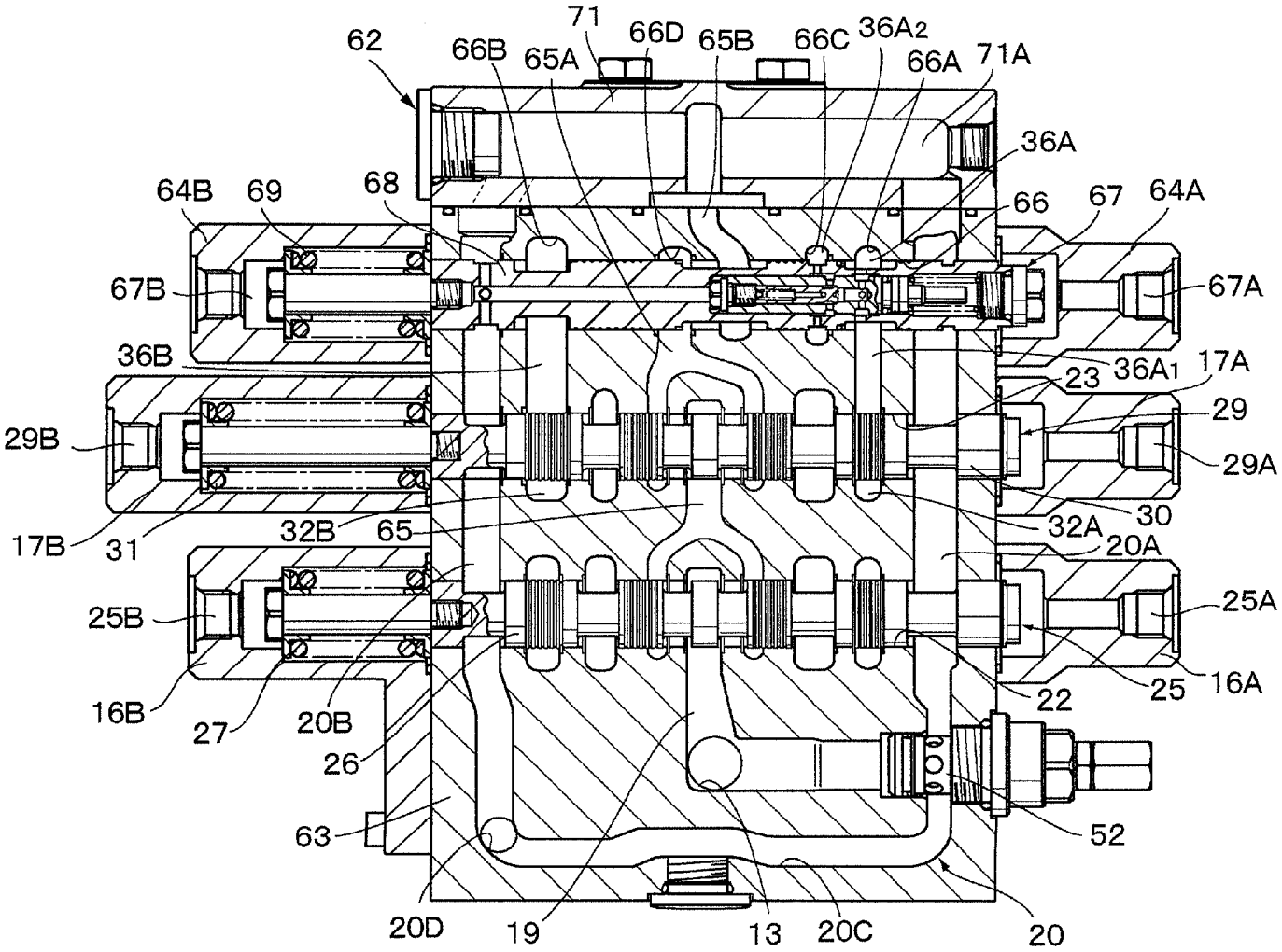
FIG. 9 is a longitudinal cross-sectional view showing a multiple valve device in FIG. 8 in enlarged form.
Figure 10:
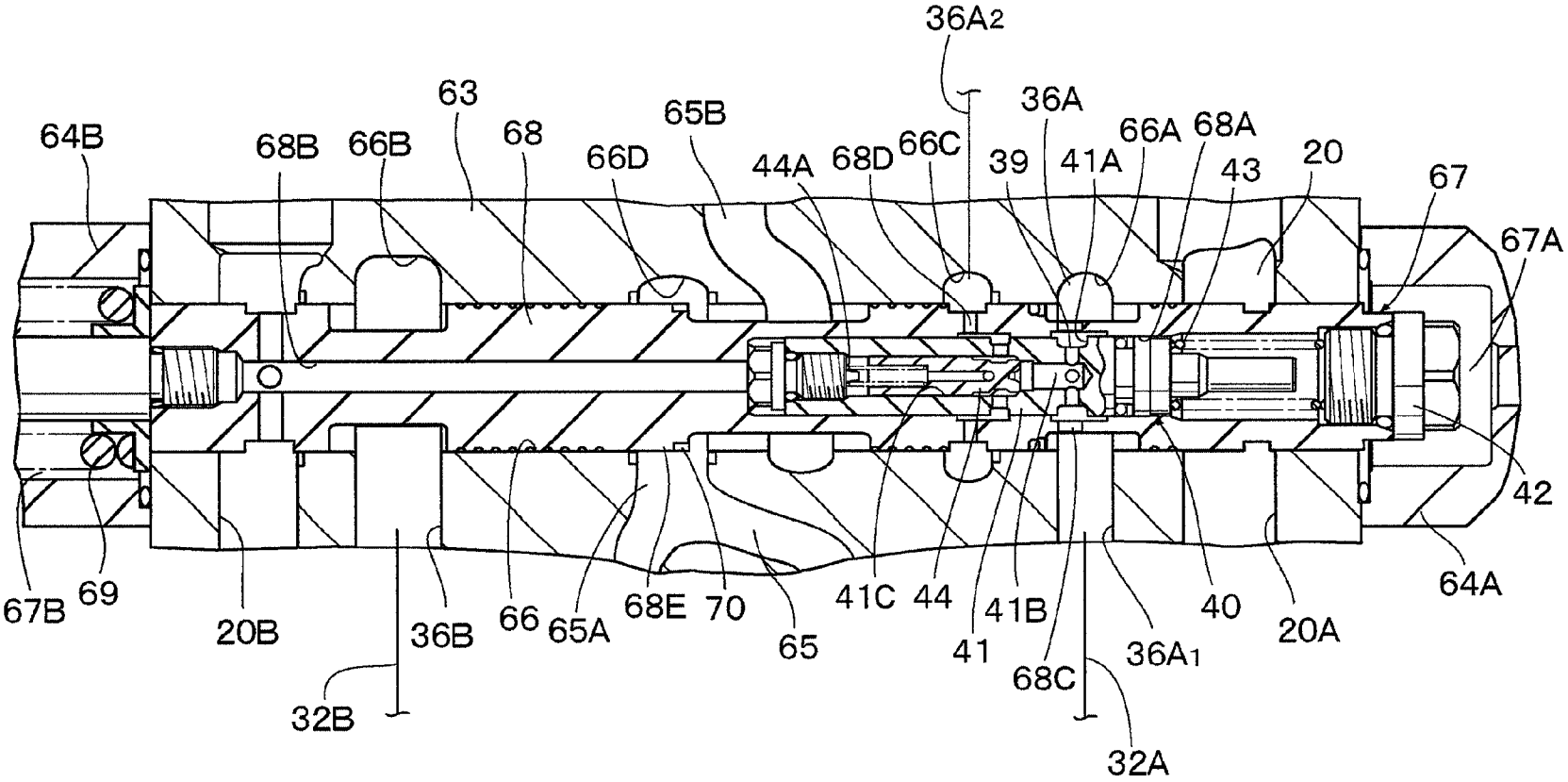
FIG. 10 is a longitudinal cross-sectional view showing a pulsation absorption control valve in FIG. 9 in enlarged form.
Figure 11:
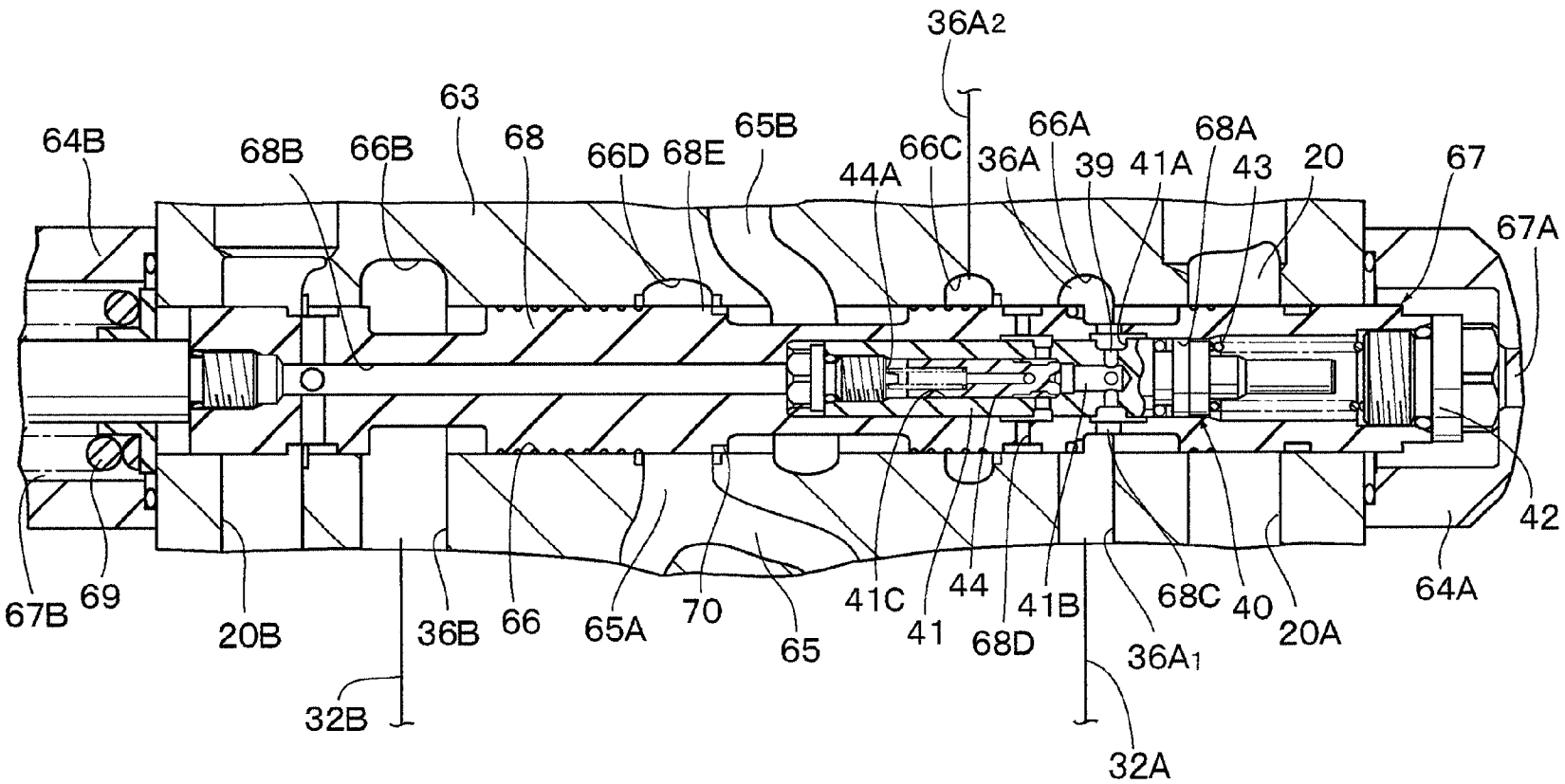
FIG. 11 is a longitudinal cross-sectional view showing a state where the pulsation absorption control valve is switched to a load generating position in the same position as in FIG. 10.

Indicated at 65 is a center bypass line provided in the valve housing 63, and the center bypass line 65 is constituted substantially in the same way with the center bypass line 21 described in the first embodiment. However, as shown in FIG. 9 to FIG. 11, the center bypass line 65 in this case has a passage configuration of being bent in positions of the spool sliding bore 66 to be described later and a halfway position is formed as one side passage 65A communicated with an oil groove 66D to be described later.

The downstream side of the center bypass line 65 is formed as the other side passage 65B communicated with the one side passage 65A via the spool sliding bore 66. The other side passage 65B is opened to an upper end surface of the valve housing 63 substantially in the same way with the connecting port 21A described in the first embodiment. The other side passage 65B is regularly communicated with the side passages 20A and 20B of the return line 20 via an oil passage 71A in a passage block 71 to be described later.

Here, communication between the one side passage 65A and the other side passage 65B of the center bypass line 65 is established through the spool sliding bore 66 to be described later. As shown in FIG. 11, a flow amount of the pressurized oil flowing in the center bypass line 65 is throttled between the one side passage 65A and the other side passage 65B by a notch 70 to be described later when a spool 68 of the pulsation absorption control valve 67 slides and is displaced until the stroke end. Therefore, the notch 70 of the spool 68 generates a hydraulic load by the pressurized oil.

Indicated at 66 is the spool sliding bore for the pulsation absorption control valve 67 provided in the valve housing 63, and the spool sliding bore 66 is constituted substantially in the same way with the spool sliding bore 24 described in the first embodiment, and both sides thereof are closed by cover members 64A and 64B. In the valve housing 63, annular oil grooves 66A and 66B are formed on the peripheral wall side of the spool sliding bore 66 to be axially (in the right-left direction) spaced. The other annular oil grooves 66C and 66D are formed between the oil grooves 66A and 66B in such a manner as to sandwich the center bypass line 65 from the right and left directions.

The oil grooves 66A to 66D are formed substantially in the same way with the oil grooves 24A to 24D described in the first embodiment. The oil grooves 66A and 66C constitute a part of the one communication line 36A connected to the main line 32A, and the other oil groove 66B constitutes a part of the other communication line 36B connected to the main line 32B. However, since the pulsation absorption control valve 67 to be described later has the configuration of the spool 68 different from that of the first embodiment, each of the oil grooves 66A to 66D of the spool sliding bore 66 also is slightly different in the arrangement and configuration from those in the first embodiment.

Designated at 67 is the pulsation absorption control valve provided in the valve housing 63, and the pulsation absorption control valve 67 is constituted substantially in the same way with the pulsation absorption control valve 33 described in the first embodiment, wherein the spool 68 is inserted and fitted into the spool sliding bore 66. However, the pulsation absorption control valve 67 has first, second, and third switching positions of a blockade position (d), a communication position (e), and a load generating position (h). Accordingly, the pulsation absorption control valve 67 is constituted by a directional control valve of three positions which is switched from the blockade position (d) as a neutral position to left and right switching positions, that is, the communication position (e) and the load generating position (h). The load generating position (h) is a switching position for applying a hydraulic load to the engine 9 as described later.

Therefore, the pulsation absorption control valve 67 includes a pair of hydraulic pilot portions 67A and 67B formed in the cover members 64A and 64B to be positioned in axial both sides of the spool 68. Different pilot pressures are supplied via pilot lines 73A and 73B to be described later to the hydraulic pilot portions 67A and 67B. A spring 69 is arranged in the hydraulic pilot portion 67B for urging the spool 68 toward the blockade position (d) as the neutral position.

Figure 8:
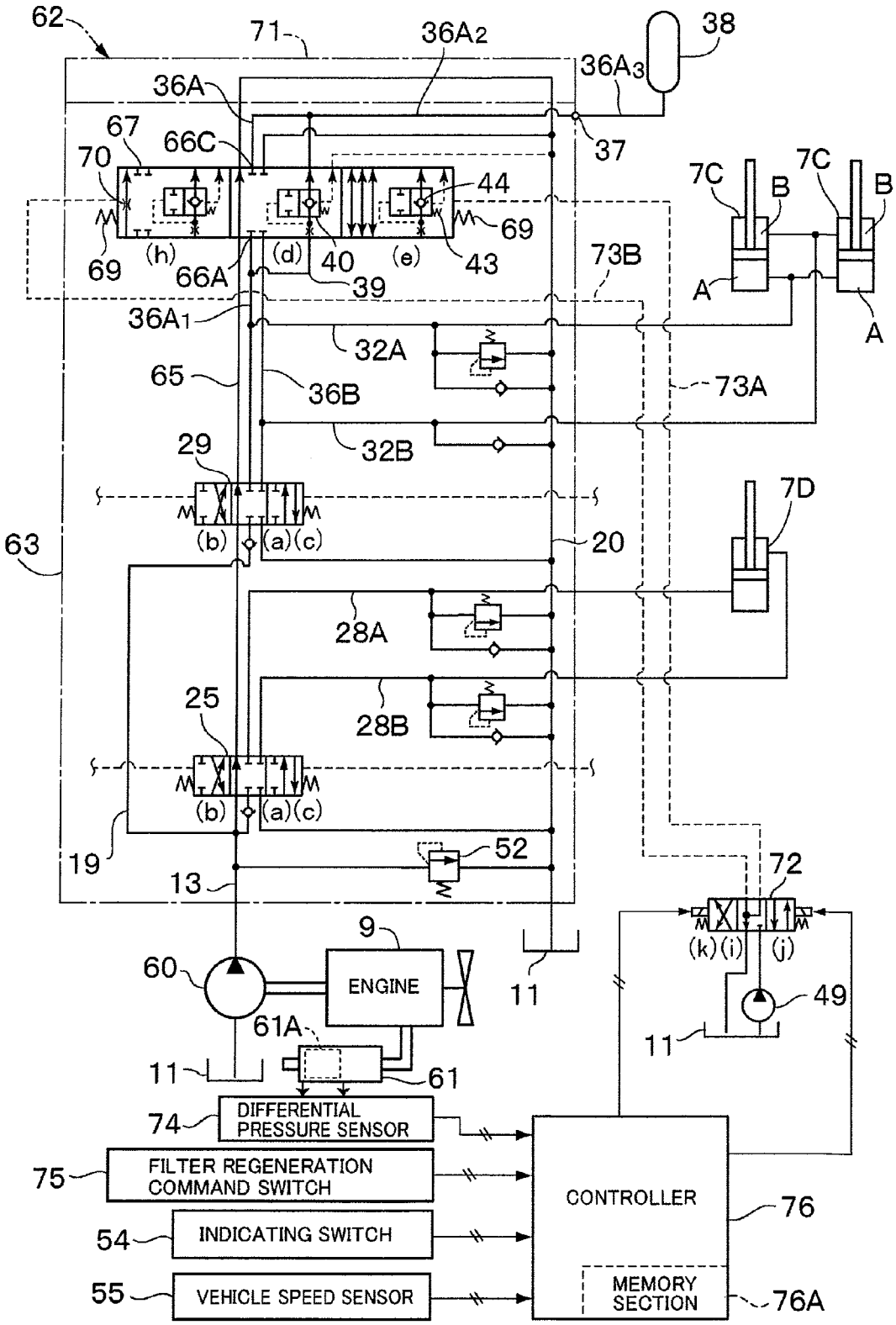
FIG. 8 is a circuit construction diagram showing a hydraulic circuit in the hydraulic control device according to a second embodiment.

The pulsation absorption control valve 67 is regularly displaced in the blockade position (d) shown in FIG. 8 by axially urging the spool 68 with the spring 69. In the blockade position (d), the communication between the bottom-side oil chamber A in the boom cylinder 7C and the accumulator 38 is blocked off in the halfway position of the communication line 36A. The pulsation absorption control valve 67 is switched from the blockade position (d) shown in FIG. 8 to a communication position (e) when a pilot pressure is supplied from the pilot line 73A to be described later to the hydraulic pilot portion 67A. In the communication position (e), the communication between the bottom-side oil chamber A and the accumulator 38 is established via the communication line 36A.

On the other hand, the pulsation absorption control valve 67 is switched from the blockade position (d) shown in FIG. 8 to a load generating position (h) when a pilot pressure is supplied from the pilot line 73B to be described later to the hydraulic pilot portion 67B. In the load generating position (h), a throttling function is applied to the pressurized oil flowing in the center bypass line 65 by a notch 70 to be described later. As a result, a hydraulic load can be generated in the discharge side of the hydraulic pump 60.

As shown in FIG. 10 and FIG. 11, a valve sliding bore 68A composed of a stepped bore extending in an axial direction and an elongated oil passage 68B for drain are formed in the spool 68 of the pulsation absorption control valve 67. The valve sliding bore 68A of the spool 68 constitutes a part of the switching valve 40 in the same way with the valve sliding bore 34A of the spool 34 described in the first embodiment. In other words, in the pulsation absorption control valve 67, the switching valve 40 is provided in the valve sliding bore 68A of the spool 68.

In addition, radial oil passage holes 68C and 68D are formed in the spool 68 to be spaced from each other in an axial direction of the valve sliding bore 68A. These oil passage holes 68C and 68D constitute a part of the bypass passage 39 in the same way with the oil passage holes 34C and 34D of the spool 34 described in the first embodiment. That is, one oil passage hole 68C supplies pressurized oil into the valve body 41 of the switching valve 40 from the outside to the inside in the radial direction. The other oil passage hole 68D functions for pressurized oil to flow toward the side of the accumulator 38 at the opening of the check valve 44.

Further, the spool 68 is provided with an annular land 68E formed in a position facing an oil groove 66D of the spool sliding bore 66. The land 68E is arranged in a position for establishing or blocking communication between the one side passage 65A and the other side passage 65B of the center bypass line 65. The land 68E of the spool 68 is provided with the notch 70 to be described later formed by notching the axial end.

Indicated at 70 is the notch constituting a throttle provided in the spool 68 in the pulsation absorption control valve 67. As shown in FIG. 10, the notch 70 is constituted by a notch formed on an outer peripheral side of an end of the land 68E in a position facing the oil groove 66D in the spool sliding bore 66. When the pulsation absorption control valve 67 is switched from the blockade position (d) as shown in FIG. 8 to the load generating position (h), as shown in FIG. 11, the spool 68 of the pulsation absorption control valve 67 slides and is displaced until the stroke end. Therefore, the notch 70 applies the throttling function to the pressurized oil flowing from the one side passage 65A to the other side passage 65B in the center bypass line 65 to generate a hydraulic load in the pressurized oil at this time.

Indicated at 71 is a passage block provided to overlap over the valve housing 63, and the passage block 71 is used by replacing the valve block 45 described in the first embodiment. The passage block 71 communicates the center bypass line 65 in the valve housing 63 via the return line 20 with the tank 11. Therefore, an oil passage 71A communicated with the other side passage 65B of the center bypass line 65 is formed in the passage block 71, and the downstream side of the oil passage 71A is regularly communicated with the side passages 20A and 20B in the return line 20, for example.

Indicated at 72 is the remote control valve operable to switch the pulsation absorption control valve 67, and the remote control valve 72 is constituted by an electromagnetic valve and is switched from a neutral position (i) to a right switching position (j) and a left switching position (k) in response to first and second switching signals outputted from a controller 76 to be described later. While the remote control valve 72 is in the neutral position (i), the pulsation absorption control valve 67 is held in the blockade position (d) by the spring 69. When the remote control valve 72 is switched from the neutral position (i) to the switching position (j), a pilot pressure is supplied to the hydraulic pilot portion 67A from the pilot line 73A. In consequence, the pulsation absorption control valve 67 is switched from the blockade position (d) shown in FIG. 8 to the communication position (e).

When the remote control valve 72 is switched from the neutral position (i) to the switching position (k), a pilot pressure is supplied to the hydraulic pilot portion 67A from the pilot line 73B. In consequence, the pulsation absorption control valve 67 is switched from the blockade position (d) shown in FIG. 8 to the load generating position (h). In the pulsation absorption control valve 67 having been switched to the load generating position (h), a flow amount of the pressurized oil flowing in the center bypass line 65 toward the side of the tank 11 is throttled by the notch 70 to generate a hydraulic load in the pressurized oil at this time.

Indicated at 74 are differential pressure sensors attached to the exhaust gas purifying device 61 of the engine 9, and the differential pressure sensors 74 are arranged at the upstream side (inlet side) and at the downstream side (outlet side) of the particulate matter removing filter 61A provided in the exhaust gas purifying device 61 to detect a differential pressure between upstream and downstream of the filter 61A. The differential pressure sensor 74 outputs the detection signal to the controller 76 to be described later. The controller 76 can estimate a deposit amount of particulate matter, unburned residues or the like attached to the particulate matter removing filter 61A by the detection signal from the differential pressure sensor 74.

Designated at 75 is a filter regeneration command switch, and the filter regeneration command switch 75 is provided in the cab 8 (refer to FIG. 1) and is manually operable by an operator to close or open. When the filter regeneration command switch 75 is operated to close, the controller 76 determines whether or not regeneration of the particulate matter removing filter 61A is performed at this timing according to the command signal at this time.

Designated at 76 is the controller as control means adopted in the second embodiment, and the controller 76 is constituted substantially in the same way with the controller 53 described in the first embodiment. However, the controller 76 has an input side connected to the indicating switch 54 of the dynamic damper and the vehicle speed sensor 55, further the differential pressure sensor 74 and the filter regeneration command switch 75, and an output side connected to the remote control valve 72 and the like. In addition, a switching processing program for the remote control valve 72 shown in FIG. 12 to be described later and the like are stored in a memory section 76A in the controller 76.

Figure 12:
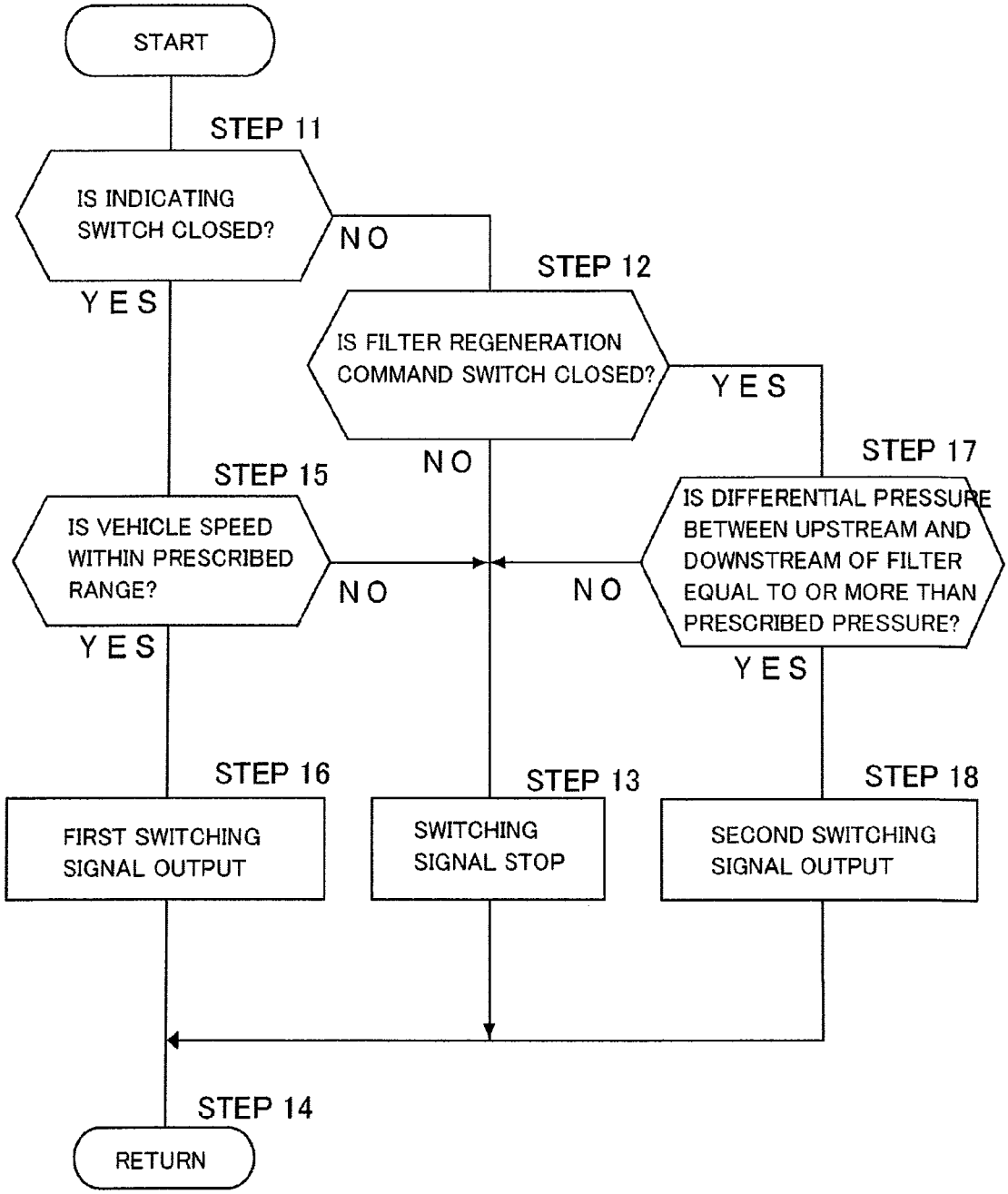
FIG. 12 is a flow chart showing a switching control process of a remote control valve by a controller in FIG. 9.

The second embodiment is constituted in this manner, and next, an explanation will be made of a switching control process of the remote control valve 72 by the controller 76 with reference to FIG. 12.

When the processing operation is started, at step 11 it is determined whether or not the indicating switch 54 for the dynamic damper is closed. While the determination of "NO" is made at step 11, it can be determined that the indicating switch 54 is opened and the wheel loader 1 is parked or stopped (including working time), and the process goes to step 12.

At next step 12, it is determined whether or not the filter regeneration command switch 75 is closed. While the determination of "NO" is made at step 12, since the command switch 54 is opened, the process goes to step 13, wherein the output of the switching signal to the remote control valve 72 is stopped to hold the remote control valve 72 in the neutral position (i) shown in FIG. 8. Therefore, the pilot pressure in each of the pilot lines 73A and 73B is lowered to a level of the tank pressure, and the pulsation absorption control valve 67 is in a state of being held in the blockade position (d) by the spring 69, and thereafter, the process goes to step 14 for return.

On the other hand, when the determination of "YES" is made at step 11, it can be determined that the indicating switch 54 is closed and the wheel loader 1 is in travel, and the process goes to step 15. At next step 15, it is determined whether or not a vehicle speed of the wheel loader 1 is within a prescribed range based upon a detection signal from the vehicle speed sensor 55. When the determination of "YES" is made at step 15, the process goes to step 16, wherein a first switching signal is outputted to the remote control valve 72 to switch the remote control valve 72 from the neutral position (i) shown in FIG. 8 to the switching position (j).

Accordingly, the pressurized oil from the pilot pump 49 is supplied as a pilot pressure into the pilot line 73A. Therefore, the pulsation absorption control valve 67 is switched from the blockade position (d) to the communication position (e) against the spring 69. That is, the spool 68 in the pulsation absorption control valve 67 axially slides and is displaced (left direction in FIG. 9) in the spool sliding bore 66 by the pilot pressure supplied to the right hydraulic pilot portion 67A shown in FIG. 9.

Therefore, in regard to the one communication line 36A formed in the valve housing 63, the communication between the first and second line sections 36A1 and 36A2 (that is, between the oil grooves 66A and 66C) is established by the spool 68 in the pulsation absorption control valve 67. In regard to the other communication line 36B also, the communication of the side of the oil groove 66B with the side passage 20B in the return line 20 is established by the spool 68. Therefore, the bottom-side oil chamber A in the boom cylinder 7C is in a state of being communicated with the accumulator 38 via the one communication line 36A, and the rod-side oil chamber B in the boom cylinder 7C is in a state of being communicated with the side of the tank 11 via the other communication line 36B. As a result, the accumulator 38 can be operated as the dynamic damper for absorbing pressure pulsations at the traveling of the vehicle.

On the other hand, when the determination of "YES" is made at step 12, since the filter regeneration command switch 75 is closed, the process goes to step 17. At next step 17, it is determined whether or not a differential pressure between upstream and downstream of the particulate matter removing filter 61A increases equal to or more than a prescribed pressure based upon a detection signal from the differential pressure sensor 74. While the determination of "NO" is made at step 17, the differential pressure found by the differential pressure sensor 74 does not increase until the prescribed pressure. That is, it can be determined that a deposit amount of particulate matter or unburned residues attached to the particulate matter removing filter 61A or the like does not reach a level required to perform the regeneration of the filter 61A. Therefore, at next step 13, the output of the switching signal to the remote control valve 72 is stopped to hold the remote control valve 72 in the neutral position (i) shown in FIG. 8.

However, when the determination of "YES" is made at step 17, it can be determined that the differential pressure between upstream and downstream of the particulate matter removing filter 61A increases equal to or more than the prescribed pressure, and the deposit amount of particulate matter, unburned residues or the like reaches the level required to perform the regeneration of the filter 61A. Therefore, at next step 18, the second switching signal is outputted to the remote control valve 72 to switch the remote control valve 72 from the neutral position (i) shown in FIG. 8 to the switching position (k).

Accordingly, the pressurized oil from the pilot pump 49 is supplied as a pilot pressure into the pilot line 73B. Therefore, the pulsation absorption control valve 67 is switched from the blockade position (d) to the load generating position (h) against the spring 69. That is, the spool 68 in the pulsation absorption control valve 67 axially slides and is displaced (right direction in FIG. 11) to the stroke end in the spool sliding bore 66 by the pilot pressure supplied to the left hydraulic pilot portion 67B.

At this time, as shown in FIG. 11, when the spool 68 in the pulsation absorption control valve 67 applies a throttling function to the pressurized oil flowing from the one side passage 65A to the other side passage 65B in the center bypass line 65 by the notch 70 to increase a hydraulic load to the hydraulic pump 60. Therefore, since a load required for the engine 9 to drive and rotate the hydraulic pump 60 increases, an injection amount of fuel is increased with an increase of the load. As a result, a combustion temperature of fuel can be increased to increase the engine output, resultantly increasing a temperature of an exhaust gas.

Thus, when the particulate matter is deposited in the particulate matter removing filter 61A in the exhaust gas purifying device 61 provided in the exhaust gas side of the engine 9 and the differential pressure in the exhaust gas between the inlet side and the outlet side of the purifying device 61 is increased more than a prescribed pressure value, the pulsation absorption control valve 67 is switched from the blockade position (d) to the load generating position (h). In consequence, the temperature of the exhaust gas can be increased to a temperature required for regenerating the particulate matter removing filter 61A or more.

As a result, a gas having a high exhaust gas temperature can be introduced into the exhaust gas purifying device 61 and the particulate matter deposited in the particulate matter removing filter 61A can be burned and cut by the high-temperature gas to smoothly perform the regeneration of the filter 61A. Therefore, even when the temperature of the exhaust gas is lowered due to an engine operation in a state where the load of the engine 9 is small, the load of the engine 9 can be increased by the hydraulic load. Accordingly, the particulate matter deposited in the particulate matter removing filter 61A in the exhaust gas purifying device 61 can be burned to perform the regeneration of the filter 61A. Therefore, the purifying treatment of the exhaust gas can be stably performed to improve reliability of the exhaust gas purifying device 61.

In this manner, even in the second embodiment thus constructed, by switching the pulsation absorption control valve 67 from the blockade position (d) to the communication position (e), the effect substantially similar to that of the first embodiment can be achieved. Particularly, according to the second embodiment, the pulsation absorption control valve 67 is constituted by the directional control valve having three switching positions. That is, the pulsation absorption control valve 67 is constituted in such a manner as to switch from the blockade position (d) to the communication position (e) and to the load generating position (h) by the pilot pressure from the remote control valve 72.

Accordingly, upon regenerating the particulate matter removing filter 61A in the exhaust gas purifying device 61, the pulsation absorption control valve 67 is switched to the load generating position (h) to apply a throttling function to the pressurized oil flowing downstream within the center bypass line 65, thus increasing the hydraulic load to the hydraulic pump 60. In consequence, the temperature of the exhaust gas can be increased to a temperature required for regenerating the particulate matter removing filter 61A or more.

Therefore, according to the second embodiment, even when the temperature of the exhaust gas is lowered due to an engine operation in a state where the load of the engine 9 is small, the hydraulic load is generated in the pressurized oil flowing in the center bypass line 65 by switching the pulsation absorption control valve 67 to the load generating position (h). Accordingly, the particulate matter deposited in the particulate matter removing filter 61A in the exhaust gas purifying device 61 can be burned to perform the regeneration of the filter 61A. As a result, the purifying treatment of the exhaust gas can be stably performed to improve reliability of the exhaust gas purifying device 61.

Further, the notch 70 provided in the spool 68 in the pulsation absorption control valve 67 can variably throttle the flow passage between the oil groove 66D of the spool sliding bore 66 and the land 68E (refer to FIG. 11) of the spool 68 when the spool 68 axially slides and is displaced within the spool sliding bore 66. Therefore, a flow amount of the pressurized oil flowing from the one side passage 65A to the other side passage 65B in the center bypass line 65 can be variably adjusted by functioning the notch 70 as a variable throttle. That is, the hydraulic load generated at this time can be variably controlled.

FIG. 13 to FIG. 16 show a hydraulic control device for a working vehicle according to a third embodiment of the present invention.

The feature of the third embodiment lies in the construction that a short circuit passage for short-circuiting a center bypass line to the side of a tank for communication is provided in a pulsation absorption control valve. At the time of performing regeneration of an exhaust gas purifying device, the pulsation absorption control valve is switched to a load generating position. In consequence, a flow passage area of the short circuit passage is throttled to generate a hydraulic load. It should be noted that, in the third embodiment, component elements that are identical to those in the foregoing first embodiment will be simply denoted by the same reference numerals to avoid repetitions of similar explanations.

In the figure, designated at 81 is an exhaust gas purifying device provided in the exhaust side of the engine 9. The exhaust gas purifying device 81 is constituted in the same way with the exhaust gas purifying device 61 described in the second embodiment and removes harmful substances contained in an exhaust gas in the engine 9 for purification. The exhaust gas purifying device 81 is provided with a particulate matter removing filter 81A and the oxidation catalyst (not shown).

Designated at 82 is a multiple valve device adopted by the third embodiment, and the multiple valve device 82 is, as substantially similar to the multiple valve device 14 described in the first embodiment, constituted to include a valve housing 83 and a valve block 45. The valve housing 83 is constituted substantially in the same way with the valve housing 15 described in the first embodiment, in which the bucket control valve 25, the boom control valve 29, and a pulsation absorption control valve 84 to be described later are arranged in parallel in such a manner as to extend in parallel with each other on the same plane.

The valve housing 83 is constituted substantially in the same way with the valve housing 63 described in the second embodiment, and the discharge line 13, the supply line 19, the return line 20, and the center bypass line 65 are formed. At both positions of left and right sides of the valve housing 83, the cover members 16A and 16B are provided in positions corresponding to the spool sliding bore 22 in the bucket control valve 25, and the cover members 17A and 17B are provided in positions corresponding to the spool sliding bore 23 in the boom control valve 29. In positions corresponding to both of the left and right sides of the spool sliding bore 66, the cover members 64A and 64B are removably provided.

The center bypass line 65 is, as described in the second embodiment, constituted such that a passage configuration thereof is bent in positions of the spool sliding bore 66, and a halfway position thereof is formed as the one side passage 65A communicated with the oil groove 66D. The downstream side of the center bypass line 65 is formed as the other side passage 65B communicated with the one side passage 65A via the spool sliding bore 66. The other side passage 65B is opened to an upper end surface of the valve housing 83. The other side passage 65B is communicated with the side passage 20A of the return line 20 via the oil passage 45B in the valve block 45.

Designated at 84 is the pulsation absorption control valve provided in the valve housing 83, and the pulsation absorption control valve 84 is constituted substantially in the same way with the pulsation absorption control valve 67 described in the second embodiment and the spool 85 is inserted and fitted into the spool sliding bore 66. The pulsation absorption control valve 84 has first, second, and third switching positions of a blockade position (d), a communication position (e), and a load generating position (m). That is, the pulsation absorption control valve 84 is constituted by a directional control valve of three positions which is switched from the blockade position (d) as a neutral position to left and right switching positions, that is, the communication position (e) and the load generating position (m).

Therefore, the pulsation absorption control valve 84 includes a pair of hydraulic pilot portions 84A and 84B formed in the cover members 64A and 64B to be positioned in axial both sides of the spool 85. Different pilot pressures are supplied via the pilot lines 73A and 73B to the hydraulic pilot portions 84A and 84B. The spring 69 is arranged in the hydraulic pilot portion 84B for urging the spool 85 toward the blockade position (d) as the neutral position.

Figure 13:
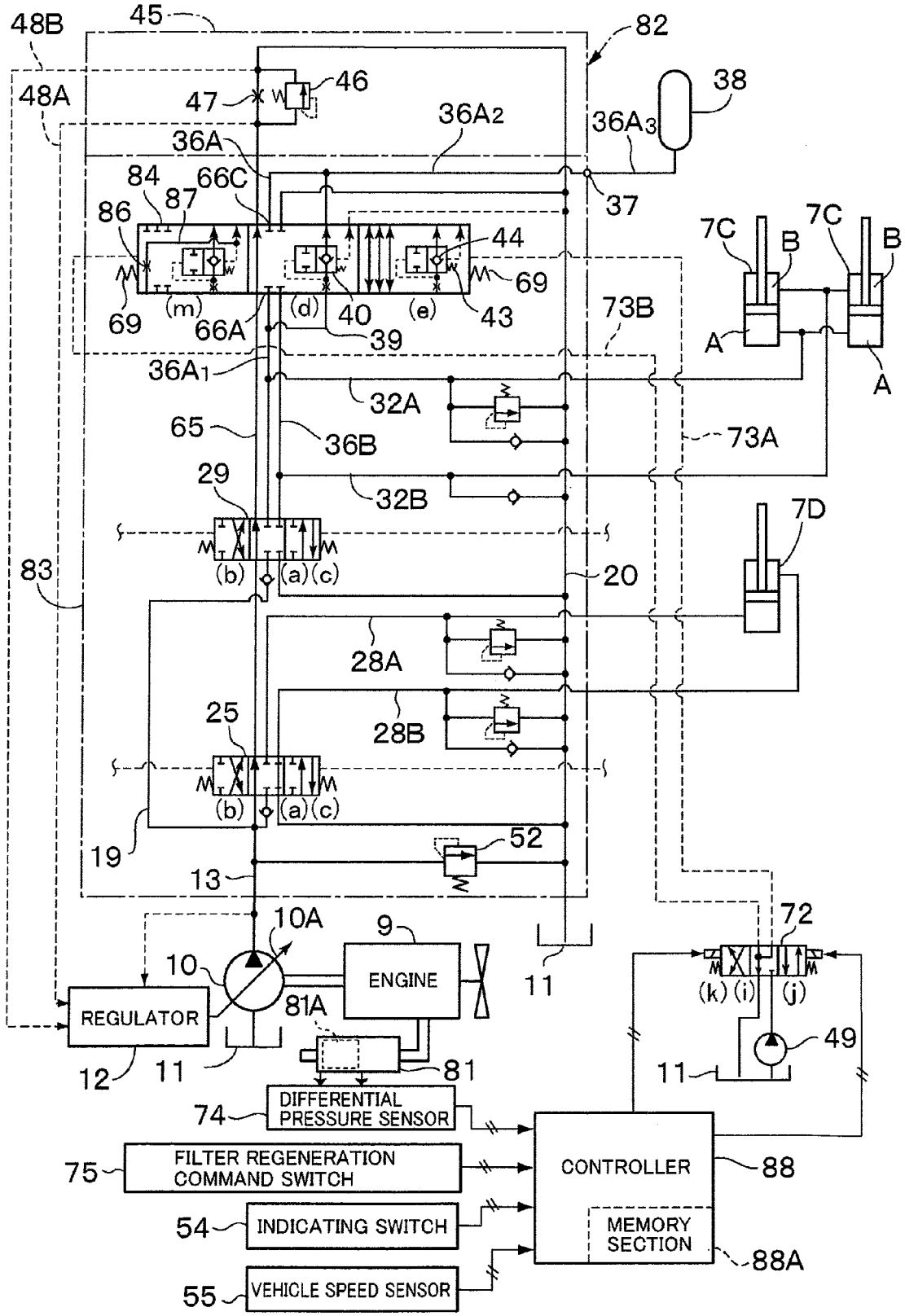
FIG. 13 is a circuit construction diagram showing a hydraulic circuit in a hydraulic control device according to a third embodiment.
Figure 14:
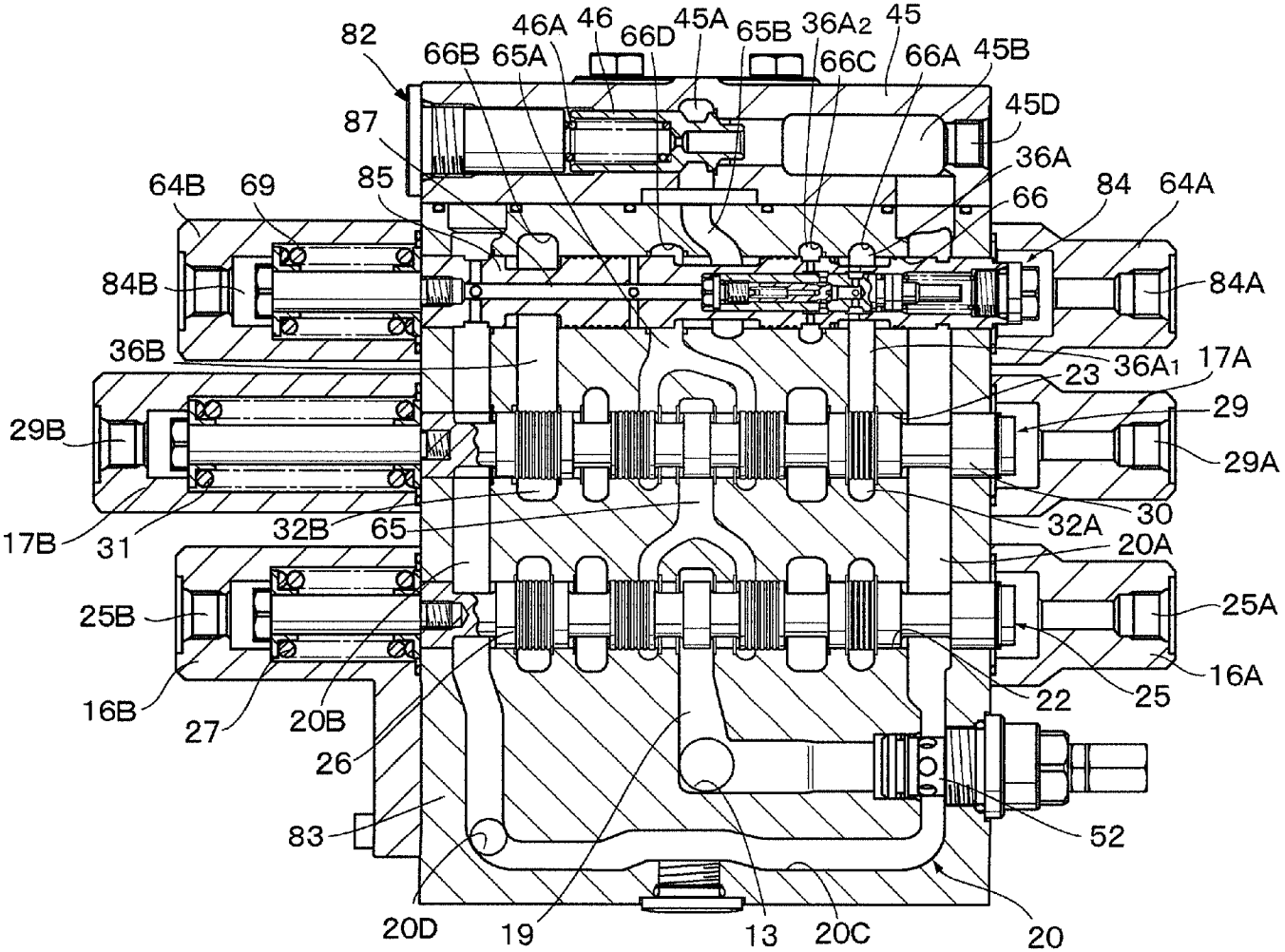
FIG. 14 is a longitudinal cross-sectional view showing a multiple valve device in FIG. 13 in enlarged form.
Figure 15:
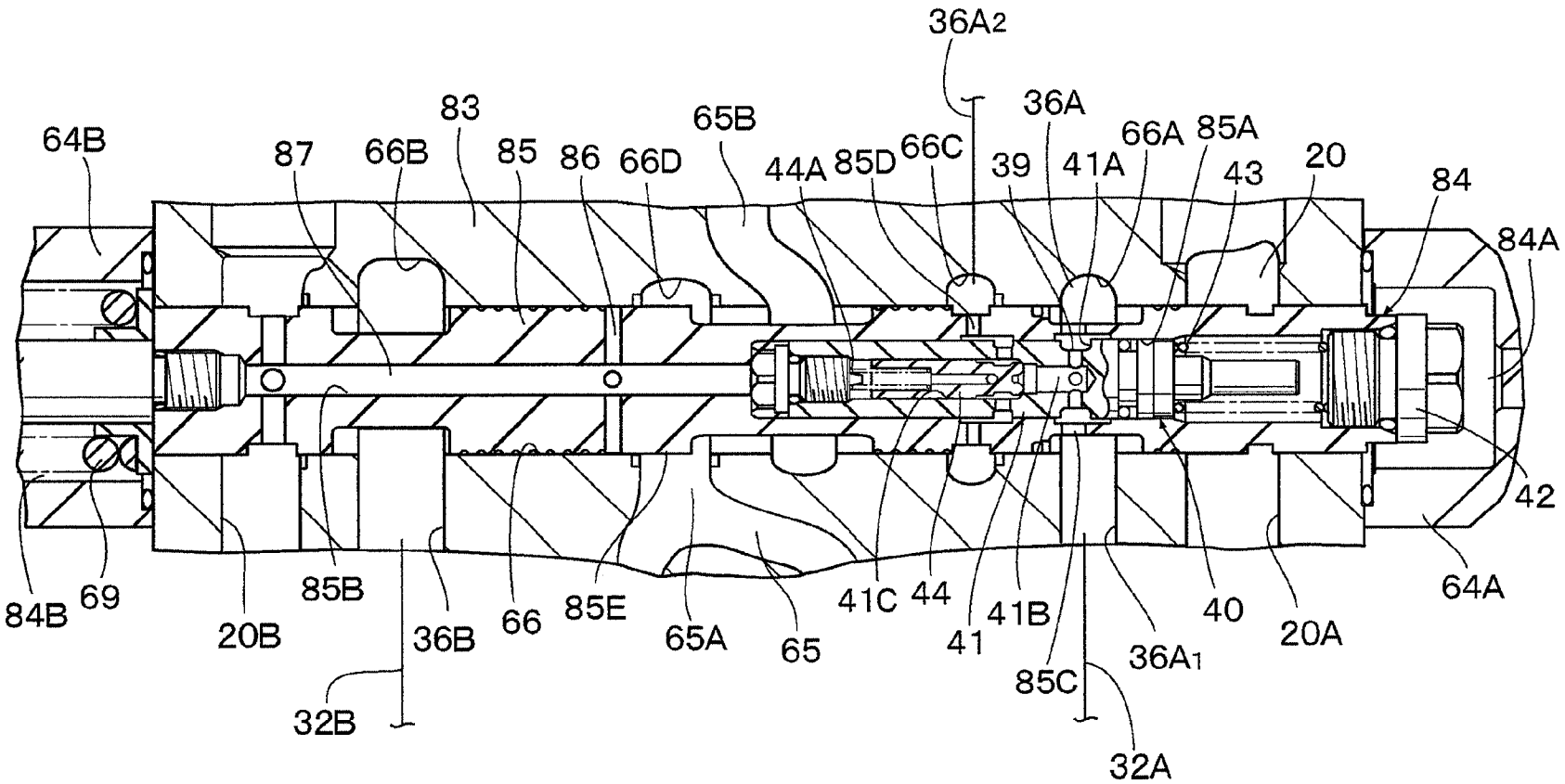
FIG. 15 is a longitudinal cross-sectional view showing a pulsation absorption control valve in FIG. 14 in enlarged form.

The pulsation absorption control valve 84 is regularly displaced in the blockade position (d) shown in FIG. 13 by axially urging the spool 85 with the spring 69. At the blockade position (d), the communication between the bottom-side oil chamber A in the boom cylinder 7C and the accumulator 38 is blocked in the halfway position of the communication line 36A. The pulsation absorption control valve 84 is switched from the blockade position (d) shown in FIG. 13 to the communication position (e) when a pilot pressure is supplied from the pilot line 73A to the hydraulic pilot portion 84A. At the communication position (e), the communication between the bottom-side oil chamber A and the accumulator 38 is established via the communication line 36A.

On the other hand, the pulsation absorption control valve 84 is switched from the blockade position (d) to the load generating position (m) when a pilot pressure is supplied from the pilot line 73B to the hydraulic pilot portion 84B. At the load generating position (m), a throttling function is applied to the pressurized oil flowing in the short circuit passage 87 to be described later by a throttle passage 86 to be described later. As a result, a hydraulic load can be generated in the discharge side of the hydraulic pump 10.

As similar to the spool 68 in the pulsation absorption control valve 67 described in the second embodiment, the spool 85 of the pulsation absorption control valve 84 is provided with a valve sliding bore 85A composed of a stepped bore extending in an axial direction and an elongated oil passage 85B for drain, which are formed therein. The valve sliding bore 85A of the spool 85 constitutes a part of the switching valve 40 in the same way with the valve sliding bore 34A of the spool 34 described in the first embodiment. The pulsation absorption control valve 84 is provided with the switching valve 40 in the valve sliding bore 85A of the spool 85.

Radial oil passage holes 85C and 85D are formed in the spool 85 to be spaced from each other in an axial direction of the valve sliding bore 85A. These oil passage holes 85C and 85D constitute a part of the bypass passage 39 in the same way with the oil passage holes 34C and 34D of the spool 34 described in the first embodiment. That is, one oil passage hole 85C supplies pressurized oil into the valve body 41 of the switching valve 40 from the outside to the inside in the radial direction. The other oil passage hole 85D functions for pressurized oil to flow toward the side of the accumulator 38 at the opening of the check valve 44.

Further, the spool 85 is provided with an annular land 85E formed in a position facing the oil groove 66D of the spool sliding bore 66. The land 85E is arranged in a position for establishing or blocking communication between the one side passage 65A and the other side passage 65B of the center bypass line 65. The spool 85 is provided with a throttle passage 86 to be described later formed radially in a position spaced by a predetermined dimension from the axial end of the land 85E.

Figure 16:
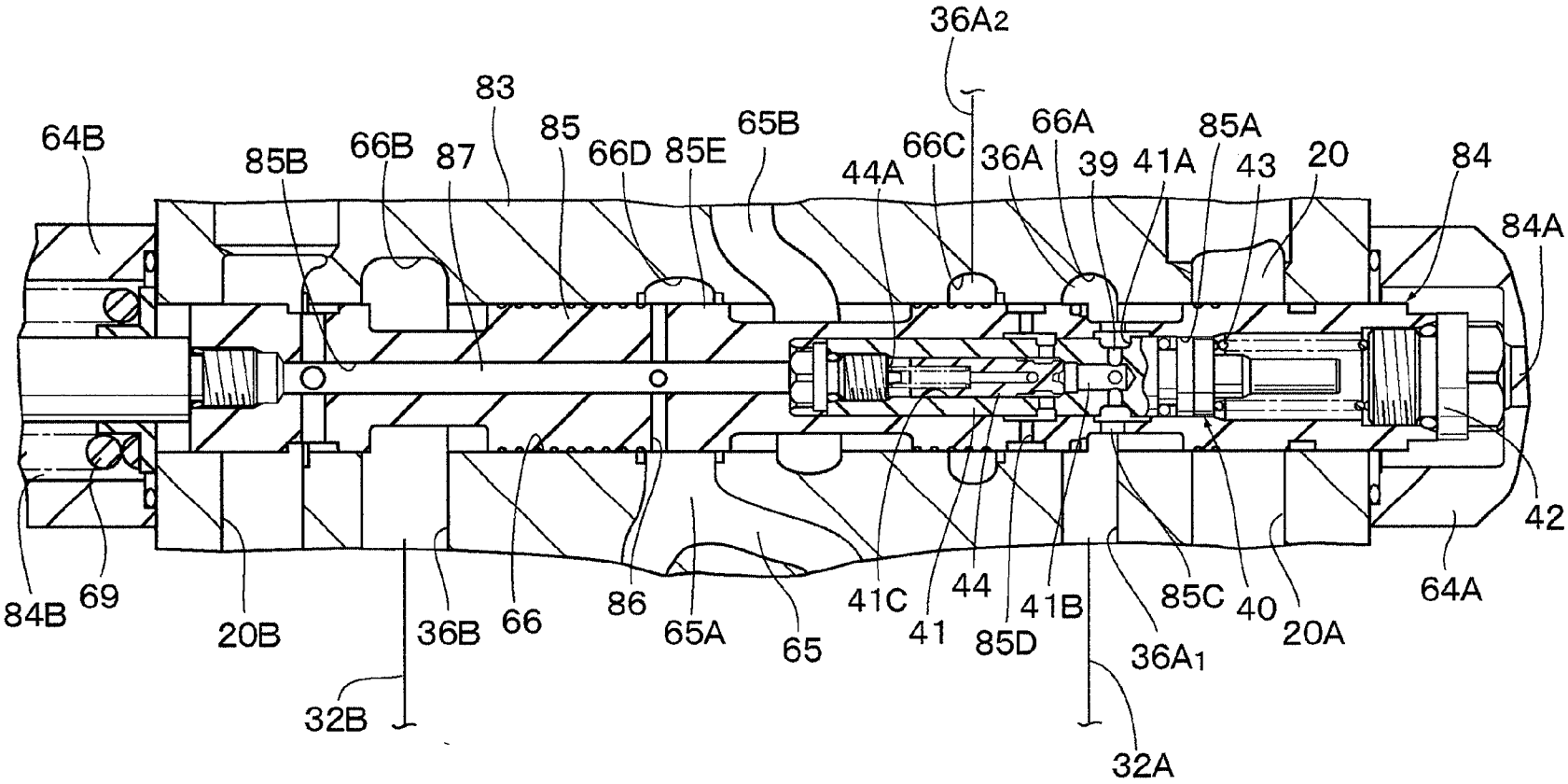
FIG. 16 is a longitudinal cross-sectional view showing a state where the pulsation absorption control valve is switched to a load generating position in the same position as in FIG. 15.
Figure 17:
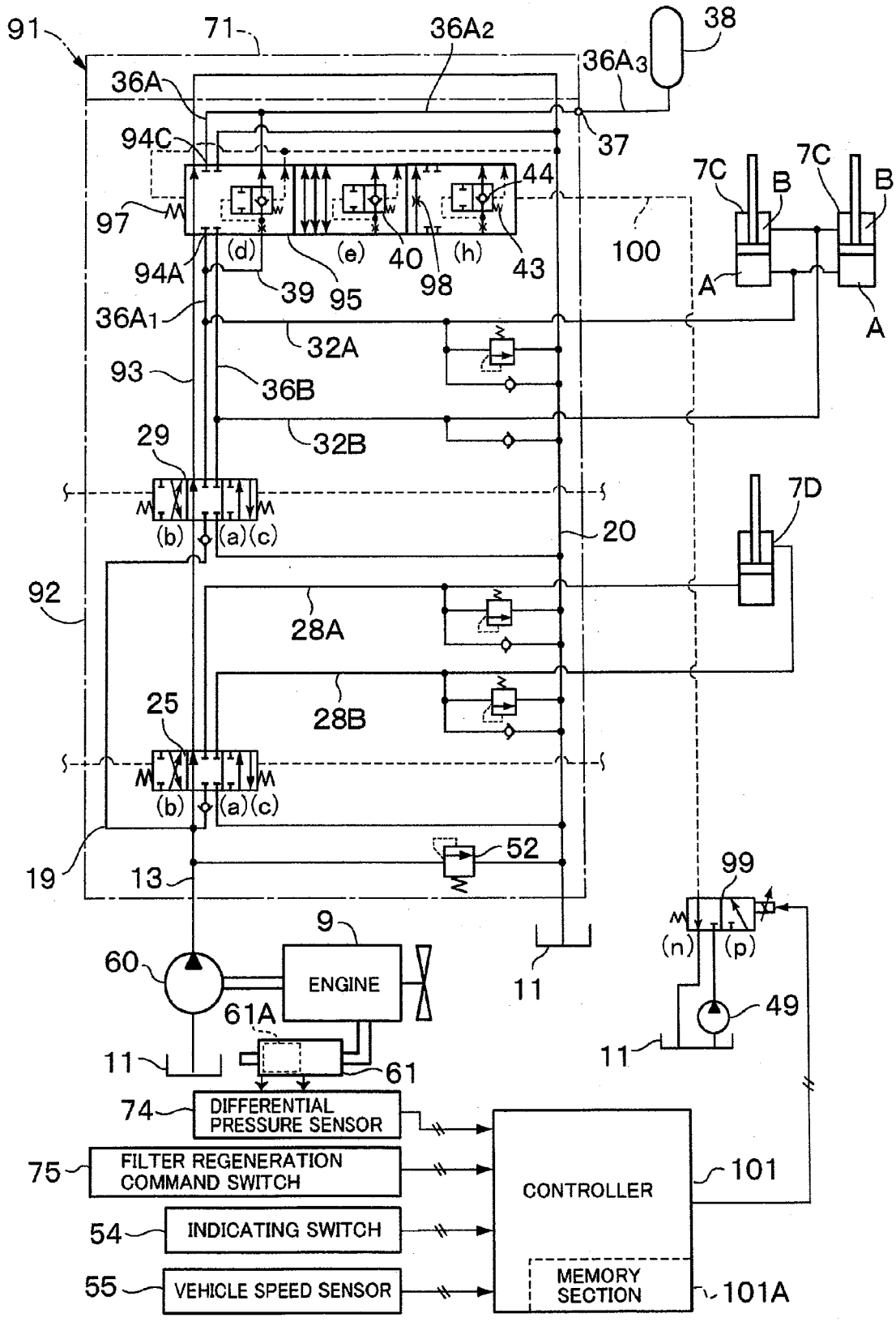
FIG. 17 is a circuit construction diagram showing a hydraulic circuit in a hydraulic control device according to a fourth embodiment.

Indicated at 86 is the radial throttle passage provided in the spool 85 in the pulsation absorption control valve 84, and the throttle passage 86 is constituted by an oil bore having a small diameter radially formed in a position crossing the oil passage 85B in the spool 85. As shown in FIG. 16, the throttle passage 86 communicates the oil passage 85B in the spool 85 with the oil groove 66D when the spool 85 slides and is displaced to the stroke end in the right direction within the spool sliding bore 66.

Indicated at 87 is the short circuit passage provided in the spool 85 of the pulsation absorption control valve 84, and the short circuit passage 87 is constituted by the oil passage 85B and the radial throttle passage 86. When the throttle passage 86 is, as described above, communicated with the oil groove 66D in the spool sliding bore 66, the short circuit passage 87 short-circuits the one side passage 65A of the center bypass line 65 to the side passage 20B of the return line 20 via the oil passage 85B in the spool 85 for communication.

At this time, as shown in FIG. 16, the land 85E of the spool 85 blocks the communication between the one side passage 65A and the other side passage 65B in the center bypass line 65 and prevents the pressurized oil from flowing from the one side passage 65A to the other side passage 65B within the center bypass line 65. As shown in FIG. 16, when the spool 85 in the pulsation absorption control valve 84 moves to the stroke end in the right direction, the pulsation absorption control valve 84 is switched from the blockade position (d) as shown in FIG. 13 to the load generating position (m). In consequence, the one side passage 65A in the center bypass line 65 is blocked off from the other side passage 65B and is communicated with the side passage 20B in the side of the tank 11 via the short circuit passage 87.

At this time, the pressurized oil flowing from the one side passage 65A in the center bypass line 65 toward the short circuit passage 87 passes through the throttle passage 86. Therefore, the throttle passage 86 applies the throttling function to the flow of the pressurized oil and as a result, the hydraulic load is generated in the pressurized oil. That is, the pulsation absorption control valve 84 can be switched from the blockade position (d) as shown in FIG. 13 to the load generating position (m) to apply the load to the engine 9 via the hydraulic pump 10.

Designated at 88 is the controller as control means adopted in the third embodiment, and the controller 88 is constituted in the same way with the controller 76 described in the second embodiment, and has an input side connected to the indicating switch 54 of the dynamic damper, the vehicle speed sensor 55, the differential pressure sensor 74 and the filter regeneration command switch 75 and an output side connected to the remote control valve 72 and the like.

The controller 88 in this case also stores the switching processing program for the remote control valve 72 (refer to FIG. 12) in a memory section 88A thereof in the same way with the second embodiment and performs control of switching the remote control valve 72 from the neutral position (i) to any one of the switching positions (j) and (k). Therefore, the pulsation absorption control valve 84 is switched from the blockade position (d) shown in FIG. 13 to any one of the communication position (e) and the load generating position (m).

In this manner, even in the third embodiment thus constructed, by switching the pulsation absorption control valve 84 from the blockade position (d) to the load generating position (m), a load can be applied via the hydraulic pump 10 to the engine 9, and the effect as substantially similar to that of the above-described second embodiment can be achieved.

Particularly, according to the third embodiment, when the pulsation absorption control valve 84 is switched from the blockade position (d) to the load generating position (m), the center bypass line 65 is short-circuited to the side of the tank 11 for communication. Therefore, as shown in FIG. 13, the pressurized oil does not flow via the center bypass line 65 in the throttle 47 provided in the downstream side of the center bypass line 65 when the pulsation absorption control valve 84 is switched from the blockade position (d) to the load generating position (m).

At this time, since a differential pressure (control pressure for negative control) between upstream and downstream of the throttle 47 supplied via the control lines 48A and 48B is reduced to be substantially zero, the regulator 12 for performing displacement control of the hydraulic pump 10 drives the displacement variable portion 10A in the hydraulic pump 10 to the side of a large flow amount to increase the discharge volume (displacement) of the hydraulic pump 10 to the maximum flow amount.

As a result, the rotation load of the engine 9 for driving the hydraulic pump 10 largely increases by switching the pulsation absorption control valve 84 to the load generating position (m). Therefore, by increasing a fuel injection amount and a fuel consumption amount of the engine 9, the temperature of the exhaust gas can be quickly increased to a temperature required for regenerating the particulate matter removing filter 81A in the exhaust gas purifying device 81 or more.

Thus, according to the third embodiment, even when the temperature of the exhaust gas is lowered due to an engine operation in a state where the load of the engine 9 is small, the hydraulic load can be generated in the pressurized oil flowing in the short circuit passage 87 by switching the pulsation absorption control valve 84 to the load generating position (m) to effectively increase the rotation load of the engine 9. Accordingly, the particulate matter deposited in the particulate matter removing filter 81A in the exhaust gas purifying device 81 can be burned to perform the regeneration of the filter 81A. As a result, the purifying treatment of the exhaust gas can be stably performed to improve reliability of the exhaust gas purifying device 81.

FIG. 17 to FIG. 21 show a hydraulic control device for a working vehicle according to a fourth embodiment of the present invention.

The feature of the fourth embodiment lies in the construction that a pulsation absorption control valve is constituted by a directional control valve having three positions and an intermediate position between a blockade position and a load generating position is set as a communication position. It should be noted that, in the fourth embodiment, component elements that are identical to those in the foregoing first embodiment will be simply denoted by the same reference numerals to avoid repetitions of similar explanations. In addition, since the hydraulic pump 60, the exhaust gas purifying device 61 and the passage block 71 are constituted in the same way as those in the aforementioned second embodiment, the explanation is omitted.

In the figure, designated at 91 is a multiple valve device adopted by the fourth embodiment, and the multiple valve device 91 is, as substantially similar to the multiple valve device 14 described in the first embodiment, constituted to include a valve housing 92 and a passage block 71. The valve housing 92 is constituted substantially in the same way with the valve housing 15 described in the first embodiment. The bucket control valve 25, the boom control valve 29, and a pulsation absorption control valve 95 to be described later are arranged in parallel in such a manner as to extend in parallel with each other on the same plane. In the valve housing 92, the discharge line 13, the supply line 19, and the return line 20 are formed substantially in the same way with the valve housing 15 described in the first embodiment.

At both of left and right sides of the valve housing 92, the cover members 16A and 16B are provided in positions corresponding to the spool sliding bore 22 in the bucket control valve 25, and the cover members 17A and 17B are provided in positions corresponding to the spool sliding bore 23 in the boom control valve 29. Further, at positions corresponding to both of the left and right sides of a spool sliding bore 94 in the pulsation absorption control valve 95 to be described later, the cover members 18A and 18B are removably provided in the same way with the first embodiment.

Figure 18:
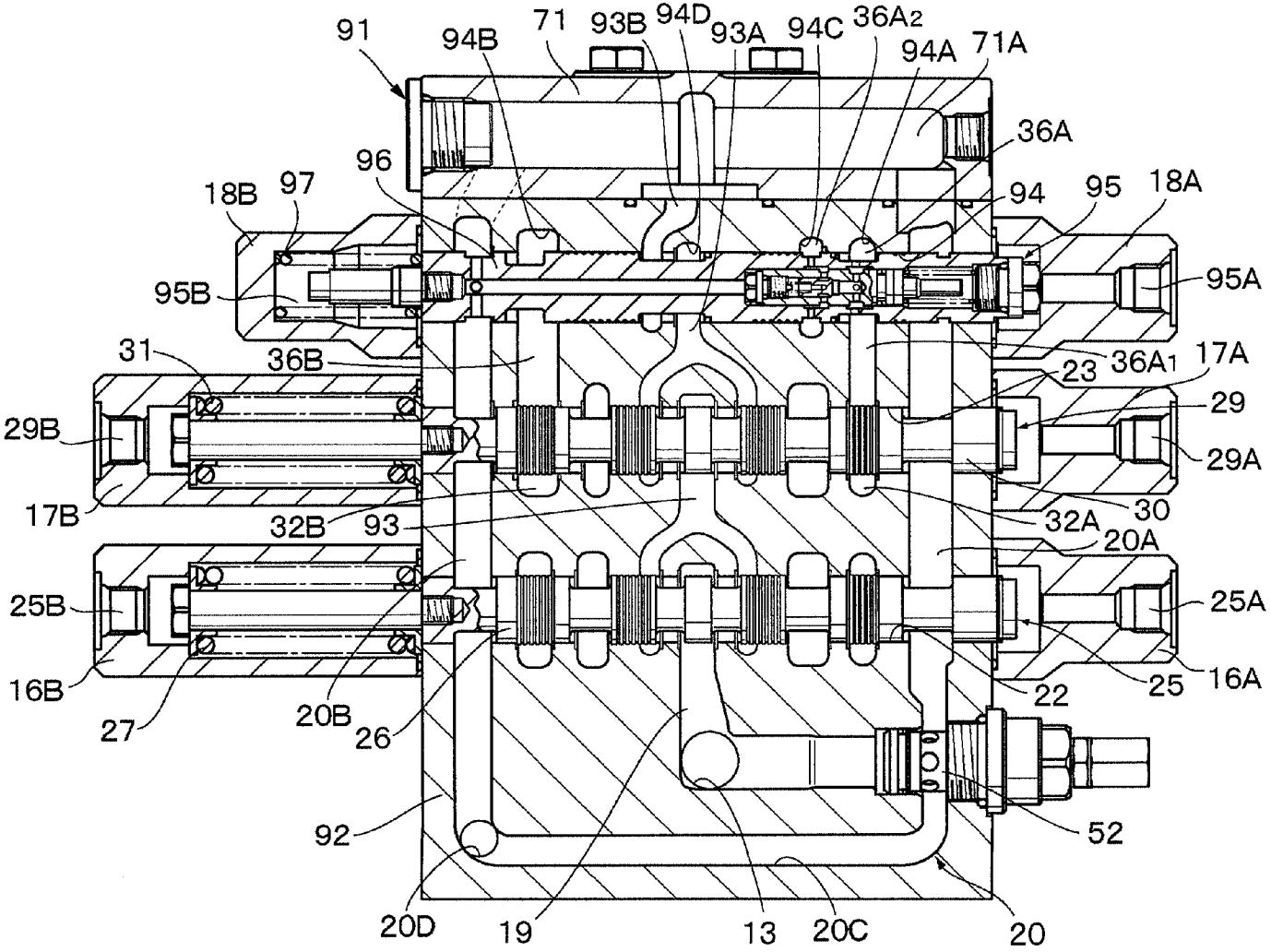
FIG. 18 is a longitudinal cross-sectional view showing a multiple valve device in FIG. 17 in enlarged form.
Figure 19:
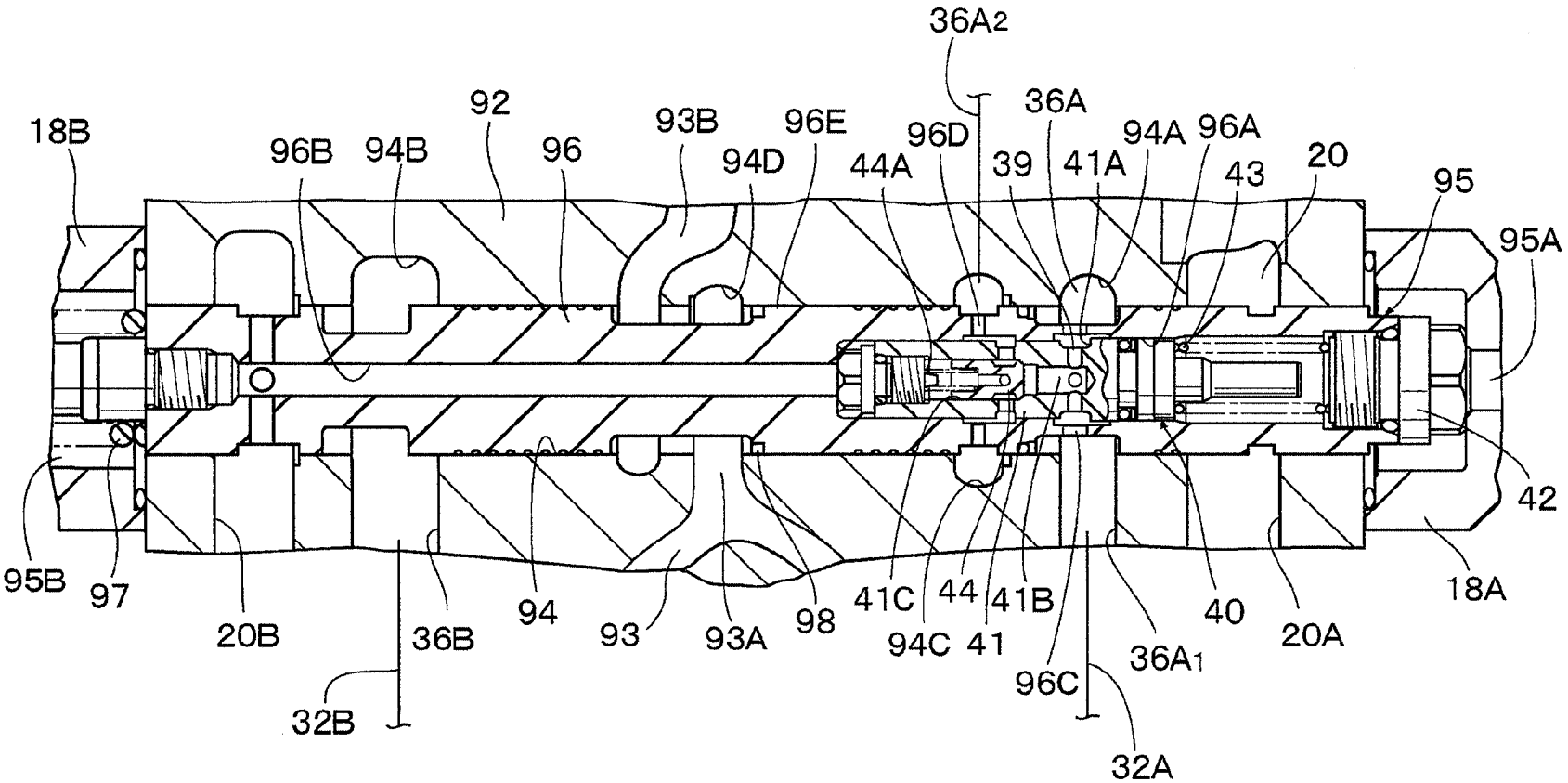
FIG. 19 is a longitudinal cross-sectional view showing a pulsation absorption control valve in FIG. 18 in enlarged form.
Figure 20:
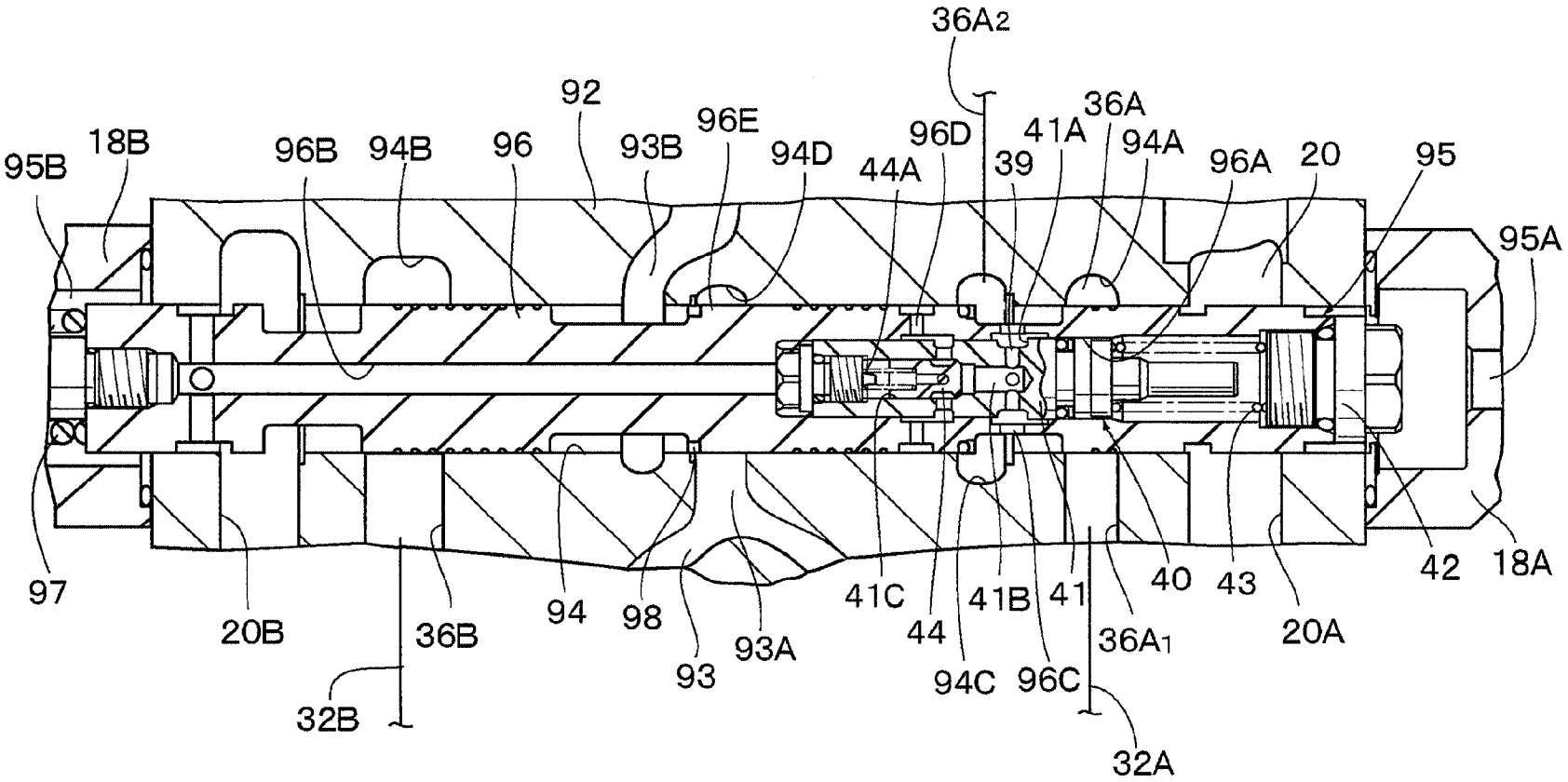
FIG. 20 is a longitudinal cross-sectional view showing a state where the pulsation absorption control valve is switched to a load generating position in the same position as in FIG. 19.

Designated at 93 is a center bypass line provided in the valve housing 92, and the center bypass line 93 is constituted substantially in the same way with the center bypass line 21 described in the first embodiment. However, as shown in FIG. 18 to FIG. 20, the center bypass line 93 has a passage configuration of being bent in positions of the spool sliding bore 94 to be described later, and a halfway position is formed as one side passage 93A communicated with an oil groove 94D to be described later.

The downstream side of the center bypass line 93 is formed as the other side passage 93B communicated with the one side passage 93A via the spool sliding bore 94. The other side passage 93B is opened to an upper end surface of the valve housing 92 substantially in the same way with the connecting port 21A described in the first embodiment. The other side passage 93B is regularly communicated with the side passages 20A and 20B of the return line 20 via the oil passage 71A in the passage block 71 as substantially similar to the second embodiment.

Here, in regard to the center bypass line 93, communication between the one side passage 93A and the other side passage 93B is established through the spool sliding bore 94 to be described later. As shown in FIG. 20, a flow amount of the pressurized oil flowing in the center bypass line 93 is throttled between the one side passage 93A and the other side passage 93B by a notch 98 to be described later when a spool 96 of the pulsation absorption control valve 95 to be described later slides and is displaced to the stroke end. As a result, a hydraulic load is generated in the center bypass line 93.

Indicated at 94 is the spool sliding bore for the pulsation absorption control valve 95 provided in the valve housing 92, and the spool sliding bore 94 is constituted substantially in the same way with the spool sliding bore 24 described in the first embodiment, and both ends thereof are closed by the cover members 18A and 18B. In the valve housing 92, annular oil grooves 94A and 94B are formed on the outer peripheral wall side of the spool sliding bore 94 to be axially (in the right-left direction) spaced. The other annular oil grooves 94C and 94D are formed between the oil grooves 94A and 94B in such a manner as to sandwich the center bypass line 93 from the right and left directions.

The oil grooves 94A to 94D are formed substantially in the same way with the oil grooves 24A to 24D described in the first embodiment. The oil grooves 94A and 94C constitute a part of the one communication line 36A connected to the main line 32A, and the other oil groove 94B constitutes a part of the other communication line 36B connected to the main line 32B. The oil groove 94D is regularly communicated with the one side passage 93A in the center bypass line 93. However, since the pulsation absorption control valve 95 to be described later has the configuration of the spool 96 different from that of the first embodiment, each of the oil grooves 94A to 94D of the spool sliding bore 94 also is slightly different in the arrangement and configuration from those in the first embodiment.

Designated at 95 is the pulsation absorption control valve provided in the valve housing 92, and the pulsation absorption control valve 95 is constituted substantially in the same way with the pulsation absorption control valve 33 described in the first embodiment and the spool 96 is inserted and fitted into the spool sliding bore 94. However, the pulsation absorption control valve 95 has first, second, and third switching positions of a blockade position (d), a communication position (e), and a load generating position (h). In this case, in the pulsation absorption control valve 95, the load generating position (h) as the third switching position is arranged in a position which is the most right side to the blockade position (d) as a neutral position, and the communication position (e) as the second switching position is arranged in an intermediate point between the blockade position (d) and the load generating position (h).

Therefore, the pulsation absorption control valve 95 includes a hydraulic pilot portion 95A and a spring chamber 95B formed in the cover members 18A and 18B to be positioned in axial both sides of the spool 96. A spring 97 is arranged in the spring chamber 95B for regularly urging the spool 96 toward the blockade position (d). The pulsation absorption control valve 95 is regularly displaced in the blockade position (d) shown in FIG. 17 by axially urging the spool 96 with the spring 97. The pulsation absorption control valve 95 is switched from the blockade position (d) to a communication position (e) when a first pilot pressure is supplied from a pilot line 100 to be described later to the hydraulic pilot portion 95A.

On the other hand, the pulsation absorption control valve 95 is switched from the blockade position (d) via the communication position (e) to the load generating position (h) when a second pilot pressure higher than the first pilot pressure is supplied from the pilot line 100 to be described later to the hydraulic pilot portion 95A. At the load generating position (h), a throttling function is applied to the pressurized oil flowing in the center bypass line 93 by a notch 98 to be described later. As a result, a hydraulic load is generated in the discharge side of the hydraulic pump 60.

As shown in FIG. 19 and FIG. 20, a valve sliding bore 96A composed of a stepped bore extending in an axial direction and an elongated oil passage 96B for drain are formed in the spool 96 of the pulsation absorption control valve 95. The valve sliding bore 96A of the spool 96 constitutes a part of the switching valve 40 in the same way with the valve sliding bore 34A of the spool 34 described in the first embodiment. The pulsation absorption control valve 95 is provided with the switching valve 40 in the valve sliding bore 96A of the spool 96.

Radial oil passage holes 96C and 96D are formed in the spool 96 to be spaced from each other in an axial direction of the valve sliding bore 96A. These oil passage holes 96C and 96D constitute a part of the bypass passage 39 in the same way with the oil passage holes 34C and 34D of the spool 34 described in the first embodiment. That is, one oil passage hole 96C supplies pressurized oil into the valve body 41 of the switching valve 40 from the outside to the inside in the radial direction. The other oil passage hole 96D functions for pressurized oil to flow toward the side of the accumulator 38 at the opening of the check valve 44.

Further, the spool 96 is provided with an annular land 96E formed in a position facing an oil groove 94D of the spool sliding bore 94. The land 96E is arranged in a position for establishing or blocking communication between the one side passage 93A and the other side passage 93B of the center bypass line 93. The land 96E of the spool 96 is provided with the notch 98 to be described later formed by notching the axial end.

Indicated at 98 is the notch constituting a throttle provided in the spool 96 in the pulsation absorption control valve 95. As shown in FIG. 19 and FIG. 20, the notch 98 is constituted by a notch formed on an outer peripheral side of an end of the land 96E in a position facing the oil groove 94D in the spool sliding bore 94. When the pulsation absorption control valve 95 is switched from the blockade position (d) via the communication position (e) to the load generating position (h), the spool 96 of the pulsation absorption control valve 95 slides and is displaced to the stroke end.

At this time, a flow mount of the pressurized oil flowing from the one side passage 93A to the other side passage 93B in the center bypass line 93 is throttled by the notch 98 of the spool 96. Thereby, a hydraulic load is generated in the pressurized oil within the center bypass line 93 upstream of the one side passage 93A by the throttling function.

Designated at 99 is the remote control valve operable to switch the pulsation absorption control valve 95, and the remote control valve 99 is constituted by an electromagnetic proportional valve. The remote control valve 99 is switched from a stop position (n) to a switching position (p) by a predetermined stroke in response to a switching signal (a magnitude of a current value) outputted from a controller 101 to be described later. While the remote control valve 99 is in the stop position (n), the pulsation absorption control valve 95 is held in the blockade position (d) by the spring 97.

When the remote control valve 99 is switched from the stop position (n) to the switching position (p) by an amount corresponding to a first stroke, a first pilot pressure is supplied to the hydraulic pilot portion 95A of the pulsation absorption control valve 95 from the pilot line 100. In consequence, the pulsation absorption control valve 95 is switched from the blockade position (d) to the communication position (e). When a current value of the switching signal outputted from the controller 101 is maximized, the remote control valve 99 is switched to the switching position (p) by a second stroke larger than the first stroke. Therefore, a second pilot pressure higher than the first pilot pressure is supplied to the hydraulic pilot portion 95A in the pulsation absorption control valve 95.

In consequence, the pulsation absorption control valve 95 is switched from the blockade position (d) via the communication position (e) to the load generating position (h). The pulsation absorption control valve 95 having been switched to the load generating position (h) throttles a flow amount of the pressurized oil flowing toward the side of the tank 11 in the center bypass line 93 by the notch 98 to generate a hydraulic load in the pressurized oil at this time.

Designated at 101 is the controller as control means adopted in the fourth embodiment, and the controller 101 is constituted substantially in the same way with the controller 76 described in the second embodiment. However, a switching processing program for the remote control valve 99 shown in FIG. 21 and the like are stored in a memory section 101A in the controller 101.

Figure 21:
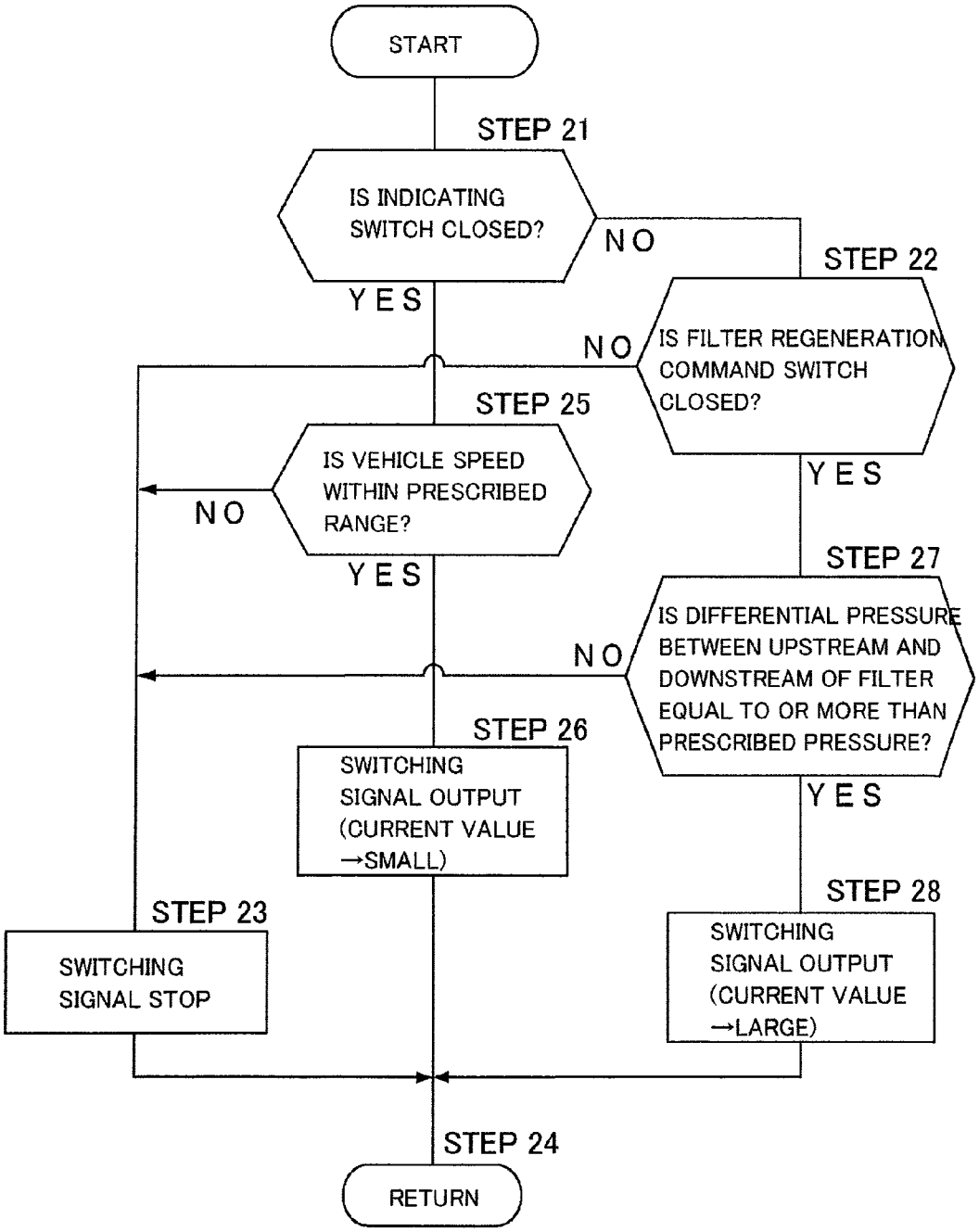
FIG. 21 is a flow chart showing a switching control process of a remote control valve by a controller in FIG. 17.

The fourth embodiment is constituted in this manner, and next, an explanation will be made of a switching control process of the remote control valve 99 by the controller 101 with reference to FIG. 21.

When the processing operation is started, at step 21, it is determined whether or not the indicating switch 54 for the dynamic damper is closed. While the determination of "NO" is made at step 21, it can be determined that the indicating switch 54 is opened and the wheel loader 1 is parked or stopped (including working time), and the process goes to step 22.

At next step 22, it is determined whether or not the filter regeneration command switch 75 is closed. While the determination of "NO" is made at step 22, since the command switch 75 is opened, the process goes to step 23. At step 23, the output of the switching signal to the remote control valve 99 is stopped to hold the remote control valve 99 in the stop position (n). Therefore, the pilot pressure in the pilot line 100 is lowered to a level of the tank pressure, and the pulsation absorption control valve 95 is in a state of being held in the blockade position (d) by the spring 97, and thereafter, the process goes to step 24.

On the other hand, when the determination of "YES" is made at step 21, it can be determined that the indicating switch 54 is closed and the wheel loader 1 is in travel. Therefore, the process goes to step 25, wherein it is determined whether or not a vehicle speed of the wheel loader 1 is within a prescribed range based upon a detection signal from the vehicle speed sensor 55. When the determination of "YES" is made at step 25, the process goes to step 26, wherein a switching signal having a small current value is outputted to the remote control valve 99 to switch the remote control valve 99 from the stop position (n) to the switching position (p) by an amount corresponding to the first stroke.

Accordingly, the pressurized oil from the pilot pump 49 is supplied as a first pilot pressure as an intermediate pressure into the pilot line 100. Therefore, the pulsation absorption control valve 95 is switched from the blockade position (d) to the intermediate communication position (e) against the spring 97. That is, the spool 96 in the pulsation absorption control valve 95 axially slides and is displaced (left direction in FIG. 19) in the spool sliding bore 94 by the pilot pressure supplied to the right hydraulic pilot portion 95A shown in FIG. 19.

Therefore, in the one communication line 36A formed in the valve housing 92, the communication between the first and second line sections 36A1 and 36A2 (that is, between the oil grooves 94A and 94C) is established by the spool 96 in the pulsation absorption control valve 95. In regard to the other communication line 36B also, the communication of the side of the oil groove 94B with the side passage 20B in the return line 20 is established by the spool 96. Therefore, the rod-side oil chamber B in the boom cylinder 7C is in a state of being communicated with the side of the tank 11 via the other communication line 36B, and the bottom-side oil chamber A in the boom cylinder 7C is in a state of being communicated with the accumulator 38 via the one communication line 36A. As a result, the accumulator 38 can be operated as the dynamic damper for absorbing pressure pulsations at the traveling of the vehicle.

On the other hand, when the determination of "YES" is made at step 22, since the filter regeneration command switch 75 is closed, the process goes to next step 27, wherein it is determined whether or not a differential pressure between upstream and downstream of the particulate matter removing filter 61A increases equal to or more than a prescribed pressure based upon a detection signal from the differential pressure sensor 74. While the determination of "NO" is made at step 27, at step 23 the output of the switching signal to the remote control valve 99 is stopped to hold the remote control valve 99 in the stop position (n) shown in FIG. 17.

However, when the determination of "YES" is made at step 27, it can be determined that the differential pressure between upstream and downstream of the particulate matter removing filter 61A in the exhaust gas purifying device 61 increases equal to or more than the prescribed pressure, and a deposit amount of particulate matter, unburned residues or the like reaches a level required for performing the regeneration of the filter. Therefore, at next step 28, a switching signal having a large current value is outputted to the remote control valve 99 to completely switch the remote control valve 99 from the stop position (n) to the switching position (p).

Accordingly, the pressurized oil from the pilot pump 49 is supplied as a pilot pressure into the pilot line 100. Therefore, the pulsation absorption control valve 95 is largely switched from the blockade position (d) via the communication position (e) to the load generating position (h) in the most left side against the spring 97. That is, the spool 96 in the pulsation absorption control valve 95 axially slides and is displaced (left direction in FIG. 18) to the stroke end in the spool sliding bore 94 by the pilot pressure supplied to the hydraulic pilot portion 95A.

At this time, as shown in FIG. 20, the spool 96 in the pulsation absorption control valve 95 applies a throttling function to the pressurized oil flowing from the one side passage 93A to the other side passage 93B in the center bypass line 93 by the notch 98 to increase a hydraulic load to the hydraulic pump 60. Therefore, since a load required for the engine 9 to drive and rotate the hydraulic pump 60 increases, an injection amount of fuel is increased with an increase of the load. As a result, a combustion temperature of fuel can be increased to increase the engine output, resultantly increasing a temperature of an exhaust gas.

Thus, when the differential pressure in the exhaust gas between the inlet side and the outlet side of the purifying device 61 provided in the exhaust gas side of the engine 9 is increased more than a prescribed pressure value, it can be determined that the particulate matter is deposited in the particulate matter removing filter 61A in the exhaust gas purifying device 61. Therefore, the pulsation absorption control valve 95 is switched from the blockade position (d) to the load generating position (h). In consequence, the temperature of the exhaust gas can be increased to a temperature required for regenerating the filter 61A in the exhaust gas purifying device 61 or more. Accordingly, the particulate matter deposited in the filter 61A can be burned to perform the regeneration of the filter 61A, and the purifying treatment of the exhaust gas can be stably performed.

In this manner, even in the fourth embodiment thus constructed, the pulsation absorption control valve 95 is constituted by the directional control valve having three switching positions, wherein, by switching the pulsation absorption control valve 95 from the blockade position (d) to the communication position (e) and the load generating position (h) by the pilot pressure from the remote control valve 99, the effect substantially similar to that of the second embodiment can be achieved.

Particularly, according to the fourth embodiment, the pulsation absorption control valve 95 is constructed in such a manner that the communication position (e) is arranged in an intermediate point between the blockade position (d) and the load generating position (h). Therefore, in a case of switching the pulsation absorption control valve 95 between the communication position (e) and the load generating position (h), the pulsation absorption control valve 95 can be switched to the load generating position (h) without passing through the blockade position (d). In this case, the pulsation absorption control valve 95 can be switched between the communication position (e) and the load generating position (h) by increasing/decreasing a current value of a switching signal outputted to the remote control valve 99 from the controller 101.

Further, even in the fourth embodiment, when the spool 96 axially slides and is displaced within the spool sliding bore 94, the notch 98 provided in the spool 96 in the pulsation absorption control valve 95 can variably throttle the flow passage between the oil groove 94D of the spool sliding bore 94 and the land 96E (refer to FIG. 20) of the spool 96. Therefore, a flow amount of the pressurized oil flowing from the one side passage 93A to the other side passage 93B in the center bypass line 93 can be variably adjusted by functioning the notch 98 as a variable throttle. That is, the hydraulic load generated in the center bypass line 93 can be variably controlled.

Figure 22:
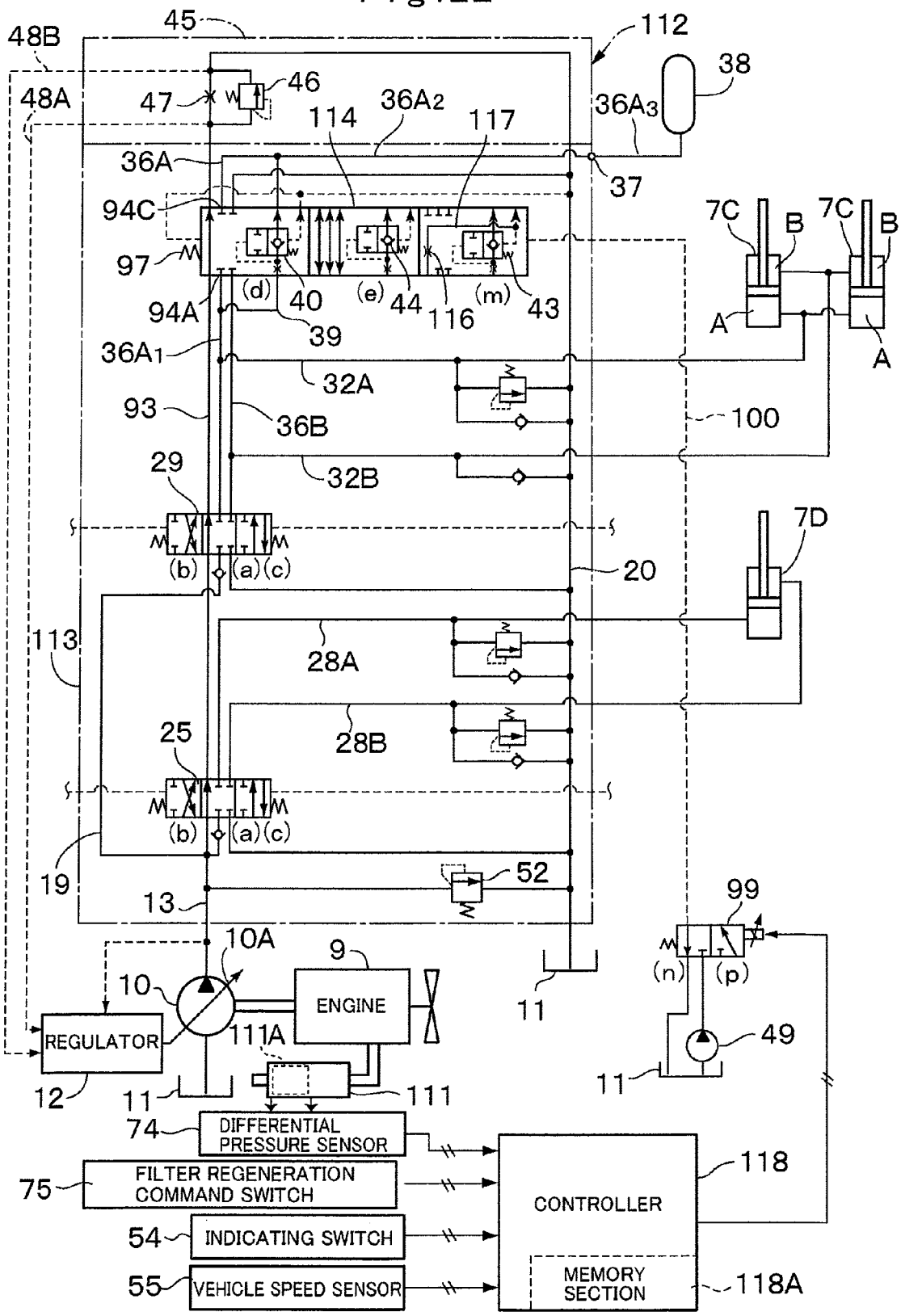
FIG. 22 is a circuit construction diagram showing a hydraulic circuit in a hydraulic control device according to a fifth embodiment.
Figure 23:
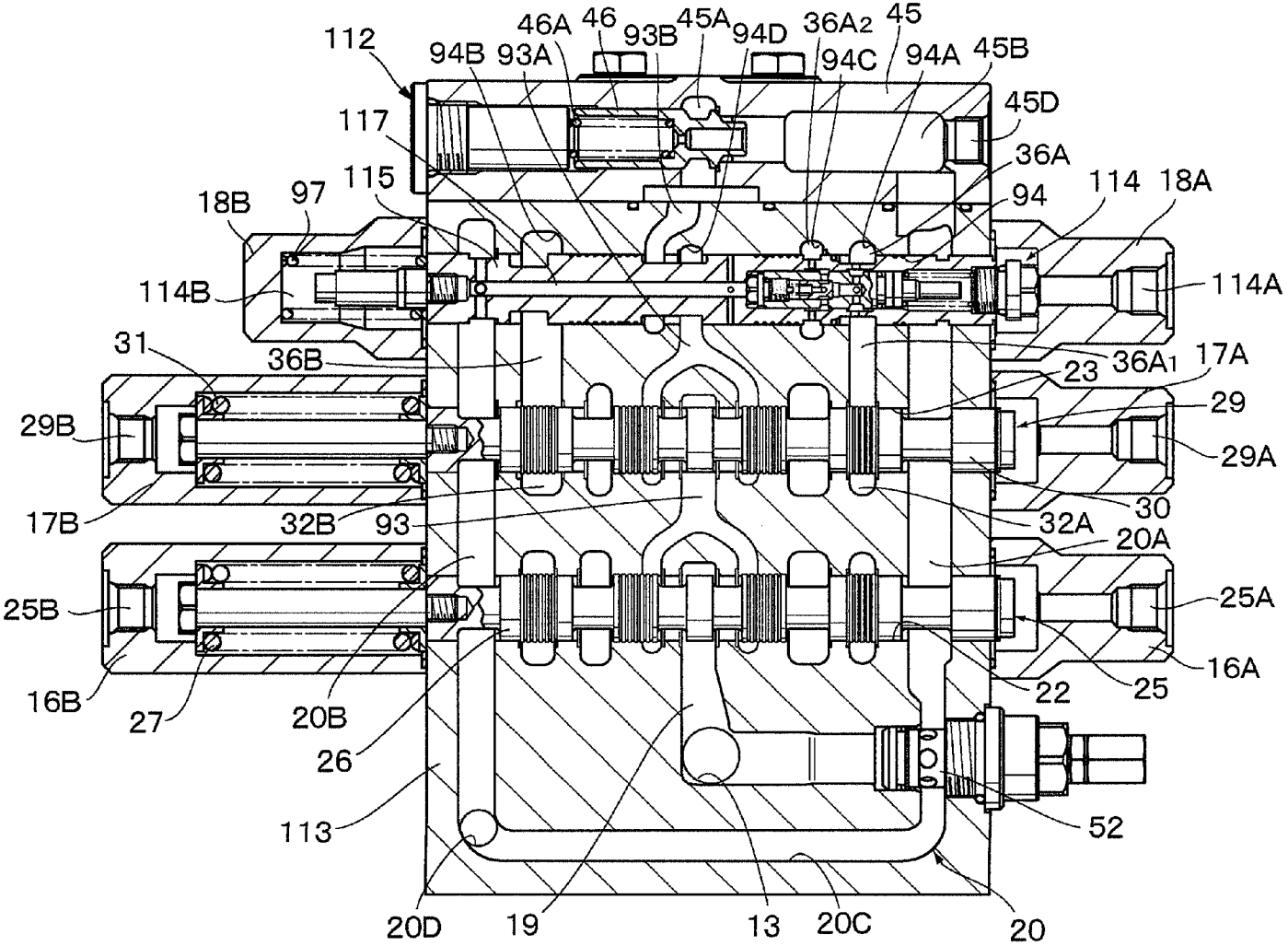
FIG. 23 is a longitudinal cross-sectional view showing a multiple valve device in FIG. 22 in enlarged form.
Figure 24:
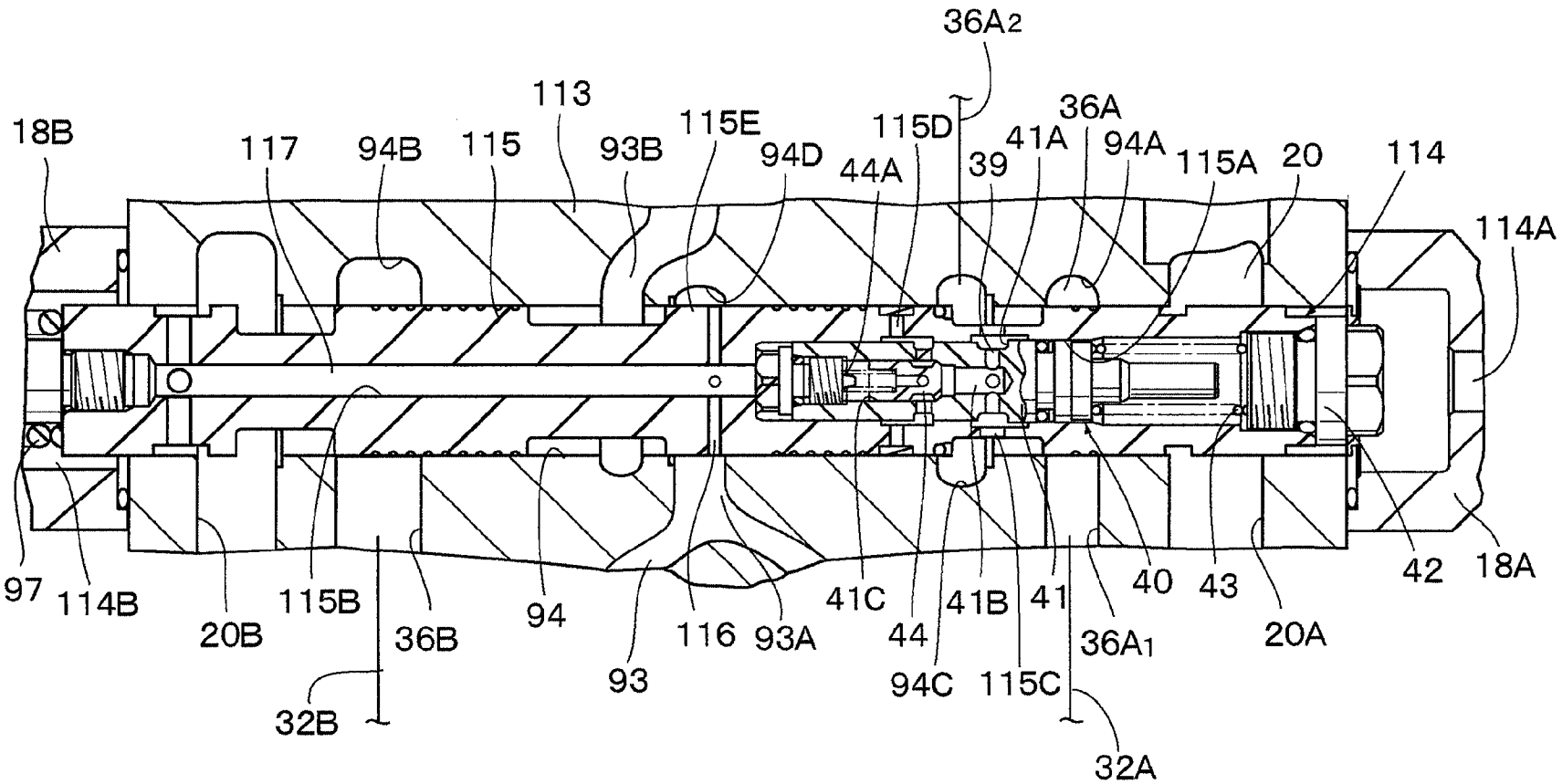
FIG. 24 is a longitudinal cross-sectional view showing a state where the pulsation absorption control valve in FIG. 23 is switched to a load generating position in enlarged form.

FIG. 22 to FIG. 24 show a hydraulic control device for a working vehicle according to a fifth embodiment of the present invention.

The feature of the fifth embodiment lies in the construction that a communication position of a pulsation absorption control valve is arranged in an intermediate point between a blockade position and a load generating position. At the time of performing regeneration of an exhaust gas purifying device, the pulsation absorption control valve is switched to the load generating position to generate a hydraulic load via a short circuit passage. It should be noted that, in the fifth embodiment, component elements that are identical to those in the foregoing first embodiment will be simply denoted by the same reference numerals to avoid similar explanations.

In the figure, designated at 111 is an exhaust gas purifying device provided in the exhaust side of the engine 9. The exhaust gas purifying device 111 is constituted in the same way with the exhaust gas purifying device 61 described in the second embodiment and is provided therein with a particulate matter removing filter 111A.

Designated at 112 is a multiple valve device adopted by the fifth embodiment, and the multiple valve device 112 is, as substantially similar to the multiple valve device 14 described in the first embodiment, constituted to include a valve housing 113 and a valve block 45. The valve housing 113 is constituted substantially in the same way with the valve housing 15 described in the first embodiment. The bucket control valve 25, the boom control valve 29, and a pulsation absorption control valve 114 to be described later are arranged in parallel in such a manner as to extend in parallel with each other on the same plane.

The valve housing 113 is constituted in the same way with the valve housing 92 described in the fourth embodiment, wherein the discharge line 13, the supply line 19, the return line 20, and the center bypass line 93 are formed. At both positions of left and right sides of the valve housing 113, the cover members 16A and 16B are provided in positions corresponding to the spool sliding bore 22 in the bucket control valve 25, and the cover members 17A and 17B are provided in positions corresponding to the spool sliding bore 23 in the boom control valve 29. In positions corresponding to both of the left and right sides of the spool sliding bore 94, the cover members 18A and 18B are removably provided.

The center bypass line 93 is, as described in the fourth embodiment, constituted such that a passage configuration thereof is bent in positions of the spool sliding bore 94, and a halfway position thereof is formed as one side passage 93A communicated with an oil groove 94D as shown in FIG. 23 and FIG. 24. The downstream side of the center bypass line 93 is formed as the other side passage 93B communicated with the one side passage 93A via the spool sliding bore 94. The other side passage 93B is opened to an upper end surface of the valve housing 113. The other side passage 93B is communicated with the side passage 20A of the return line 20 via the oil passage 45B in the valve block 45.

Designated at 114 is the pulsation absorption control valve provided in the valve housing 113, and the pulsation absorption control valve 114 is constituted substantially in the same way with the pulsation absorption control valve 95 described in the fourth embodiment and a spool 115 is inserted and fitted into the spool sliding bore 94. The pulsation absorption control valve 114 has first, second, and third switching positions of a blockade position (d), a communication position (e), and a load generating position (m). That is, in the pulsation absorption control valve 114, the load generating position (m) as the third switching position is arranged in the most right position to the blockade position (d) as a neutral position, and the communication position (e) as the second switching position is arranged in an intermediate point between the blockade position (d) and the load generating position (m).

Therefore, the pulsation absorption control valve 114 includes a hydraulic pilot portion 114A and a spring chamber 114B formed in the cover members 18A and 18B to be positioned in axial both sides of the spool 115. The spring 97 is arranged in the spring chamber 114B for urging the spool 115 toward the blockade position (d). The pulsation absorption control valve 114 is regularly displaced in the blockade position (d) by axially urging the spool 115 with the spring 97. The pulsation absorption control valve 114 is switched from the blockade position (d) to the communication position (e) when a first pilot pressure is supplied from the pilot line 100 to the hydraulic pilot portion 114A.

On the other hand, the pulsation absorption control valve 114 is switched from the blockade position (d) via the communication position (e) to the load generating position (m) when a second pilot pressure higher than the first pilot pressure is supplied from the pilot line 100 to the hydraulic pilot portion 114A. At the load generating position (m), a throttling function is applied to the pressurized oil flowing in a short circuit passage 117 to be described later from the center bypass line 93 by a throttle passage 116. As a result, a hydraulic load is generated in the discharge side of the hydraulic pump 10.

The spool 115 of the pulsation absorption control valve 114 is provided with a valve sliding bore 115A composed of a stepped bore extending in an axial direction and an elongated oil passage 115B for drain, which are formed therein. The valve sliding bore 115A of the spool 115 constitutes a part of the switching valve 40 in the same way with the valve sliding bore 34A of the spool 34 described in the first embodiment. The pulsation absorption control valve 114 is provided with the switching valve 40 in the valve sliding bore 115A of the spool 115.

Radial oil passage holes 115C and 115D are formed in the spool 115 to be spaced from each other in an axial direction of the valve sliding bore 115A. These oil passage holes 115C and 115D constitute a part of the bypass passage 39 in the same way with the oil passage holes 34C and 34D of the spool 34 described in the first embodiment. That is, one oil passage hole 115C supplies pressurized oil into the valve body 41 of the switching valve 40 from the outside to the inside in the radial direction. The other oil passage hole 115D functions for pressurized oil to flow toward the side of the accumulator 38 at the opening of the check valve 44.

Further, the spool 115 is provided with an annular land 115E formed in a position facing the oil groove 94D of the spool sliding bore 94. The land 115E is arranged in a position for establishing or blocking communication between the one side passage 93A and the other side passage 93B of the center bypass line 93. The spool 115 is provided with a throttle passage 116 to be described later radially formed in a position spaced by a predetermined dimension from the axial end of the land 115E.

Indicated at 116 is the radial throttle passage provided in the spool 115 in the pulsation absorption control valve 114, and the throttle passage 116 is constituted by an oil bore having a small diameter radially formed in a position crossing the oil passage 115B in the spool 115. As shown in FIG. 24, the throttle passage 116 communicates the oil passage 115B in the spool 115 with the oil groove 94D when the spool 115 slides and is displaced to the stroke end in the right direction within the spool sliding bore 94.

Indicated at 117 is the short circuit passage provided in the spool 115 of the pulsation absorption control valve 114, and the short circuit passage 117 is constituted by the oil passage 115B and the radial throttle passage 116. When the throttle passage 116 is, as described above, communicated with the oil groove 94D in the spool sliding bore 94, the short circuit passage 117 short-circuits the one side passage 93A of the center bypass line 93 to the side passage 20B of the return line 20 via the oil passage 115B in the spool 115 for communication.

At this time, as shown in FIG. 24, the land 115E of the spool 115 blocks the communication between the one side passage 93A and the other side passage 93B in the center bypass line 93 and prevents the pressurized oil from flowing from the one side passage 93A to the other side passage 93B within the center bypass line 93. When the spool 115 in the pulsation absorption control valve 114 moves to the stroke end in the right direction, the pulsation absorption control valve 114 is switched from the blockade position (d) shown in FIG. 22 to the load generating position (m). In consequence, the one side passage 93A in the center bypass line 93 is blocked off from the other side passage 93B and is communicated with the side passage 20B in the side of the tank 11 via the short circuit passage 117.

In this case, the pressurized oil flowing from the one side passage 93A in the center bypass line 93 toward the short circuit passage 117 passes through the throttle passage 116. Therefore, the throttle passage 116 applies the throttling function to the flow of the pressurized oil to generate the hydraulic load in the pressurized oil at this time. That is, the pulsation absorption control valve 114 can be switched from the blockade position (d) to the load generating position (m) to apply the load to the engine 9 via the hydraulic pump 10.

Designated at 118 is the controller as control means adopted in the fifth embodiment, and the controller 118 is constituted substantially in the same way with the controller 101 described in the fourth embodiment, and has an input side connected to the indicating switch 54 of the dynamic damper, the vehicle speed sensor 55, the differential pressure sensor 74 and the filter regeneration command switch 75 and an output side connected to the remote control valve 99 and the like.

In this case, the controller 118 stores the switching processing program for the remote control valve 99 (refer to FIG. 21) in a memory section 118A thereof in the same way with the fourth embodiment and performs control of switching the remote control valve 99 from the stop position (n) to the switching position (p) by a two-step stroke in response to a magnitude of a current value of a switching signal. Therefore, the pulsation absorption control valve 114 is switched from the blockade position (d) to the communication position (e) and further, also to the load generating position (m).

In this manner, even in the fifth embodiment thus constructed, by switching the pulsation absorption control valve 114 from the blockade position (d) via the communication position (e) to the load generating position (m), a load can be applied through the hydraulic pump 10 to the engine 9 to obtain the effect substantially similar to that of the fourth embodiment.

Particularly, according to the fifth embodiment, when the pulsation absorption control valve 114 is switched from the blockade position (d) to the load generating position (m), the center bypass line 93 is short-circuited to the side of the tank 11 for communication. Therefore, the pressurized oil does not flow via the center bypass line 93 in the throttle 47 provided in the downstream side of the center bypass line 93 when the pulsation absorption control valve 114 is switched from the blockade position (d) to the load generating position (m).

At this time, since a differential pressure (control pressure for negative control) between upstream and downstream of the throttle 47 in the pressurized oil supplied via the control lines 48A and 48B is reduced to be substantially zero, the regulator 12 for performing displacement control of the hydraulic pump 10 drives the displacement variable portion 10A in the hydraulic pump 10 to the side of a large flow amount to increase the discharge volume (displacement) of the hydraulic pump 10 to the maximum flow amount.

As a result, the rotation load of the engine 9 for driving the hydraulic pump 10 largely increases by switching the pulsation absorption control valve 114 to the load generating position (m). Therefore, by increasing a fuel injection amount and a fuel consumption amount of the engine 9, an exhaust temperature in the engine 9 can be quickly increased to a temperature required for regenerating the particulate matter removing filter 111A in the exhaust gas purifying device 111 or more.

Therefore, according to the fifth embodiment, even when the temperature of the exhaust gas is lowered due to an engine operation in a state where the load of the engine 9 is small, the hydraulic load can be generated in the pressurized oil flowing in the short circuit passage 117 by switching the pulsation absorption control valve 114 to the load generating position (m) to effectively increase the rotation load of the engine 9. Accordingly, the particulate matter deposited in the particulate matter removing filter 111A in the exhaust gas purifying device 111 can be burned to perform the regeneration of the filter 111A.

It should be noted that, in the first embodiment, an explanation is made by taking a case where the check valve 44 is provided in the valve body 41 of the switching valve 40 as an example. However, the present invention is not limited thereto, and the present invention may be constructed such that a check valve is provided in the halfway point of a bypass passage to be positioned outside of a switching valve, for example, wherein the check valve prevents the pressurized oil from flowing from an accumulator via the bypass passage toward a hydraulic actuator. This point can be applied in the same way to the second to fifth embodiments.

In the first embodiment, an explanation is made by taking a case where the switching valve 40 is provided in the spool 34 in the pulsation absorption control valve 33 as an example. However, the present invention is not limited thereto, and the present invention may be constructed such that a switching valve is provided in the halfway point of a bypass passage to be positioned outside of the pulsation absorption control valve, for example, wherein the switching valve blocks communication between a hydraulic actuator and an accumulator through a bypass passage. This point can be applied in the same way to the second to fifth embodiments.

Further, in the first embodiment, an explanation is made by taking the wheel loader 1 as the working vehicle equipped with the hydraulic control device, as an example. However, the present invention is not limited thereto, and the present invention can be widely applied to a construction machine such as a hydraulic excavator, a forklift, a crane or a bulldozer equipped with a wheel type traveling structure, or a working vehicle other than the construction machine. This point can be applied in the same way to the second to fifth embodiments.

DESCRIPTION OF REFERENCE NUMERALS

1: Wheel loader (Working vehicle)
2: Vehicle body
7: Working mechanism
7A: Boom
7B: Loader bucket
7C: Boom cylinder (Hydraulic actuator)
7D: Bucket cylinder (Hydraulic actuator)
8: Cab
9: Engine
10, 60: Hydraulic pump (Hydraulic source)
11: Operating oil tank
12: Regulator (Displacement control means)
14, 62, 82, 91, 112: Multiple valve device
15, 63, 83, 92, 113: Valve housing
19: Supply line
20: Return line
21, 65, 93: Center bypass line
22, 23, 24, 66, 94: Spool sliding bore
25: Bucket control valve (Directional control valve)
26, 30, 34, 68, 85, 96, 115: Spool
29: Boom control valve (Directional control valve)
32A, 32B: Main line
33, 67, 84, 95, 114: Pulsation absorption control valve
36A: One communication line
36B: Other communication line
38: Accumulator
39: Bypass passage
40: Switching valve
44: Check valve
45: Valve block
46: Relief valve
47: Throttle
48A, 48B: Control line
49: Pilot pump
50, 73A, 73B, 100: Pilot line
51, 72, 99: Remote control valve
53, 76, 88, 101, 118: Controller (Control means)
54: Indicating switch of dynamic damper
55: Vehicle speed sensor
61, 81, 111: Exhaust gas purifying device
61A, 81A, 111A: Particulate matter removing filter
70, 98: Notch (Throttle)
71: Passage block
74: Differential pressure sensor
75: Filter regeneration command switch
86, 116: Throttle passage
87, 117: Short circuit passage
d: Blockade position
e: Communication position
h, m: Load generating position

The invention claimed is:

1. A hydraulic control device for a working vehicle comprising:

a hydraulic pump constituting a hydraulic source for said working vehicle together with a tank;

at least one or more hydraulic actuators driven by pressurized oil discharged from said hydraulic pump;

a directional control valve for controlling switching of the pressurized oil to be supplied to said hydraulic actuator from said hydraulic pump;

a pair of main lines for establishing connection between said directional control valve and said hydraulic actuator;

an accumulator connected via one communication line branched from one main line out of said pair of said main lines to said hydraulic actuator to absorb pressure pulsations generated in said hydraulic actuator; and a pulsation absorption control valve provided in the halfway point of said one communication line to establish or block communication between said hydraulic actuator and said accumulator, wherein said directional control valve is arranged in the halfway point of a center bypass line for connecting said hydraulic pump to said tank to control switching of said pair of said main lines together with said center bypass line, wherein said one main line out of said pair of said main lines is connected to said one communication line in a position between said directional control valve and said pulsation absorption control valve, and said other main line is connected to said other communication line which is communicated with or blocked off from said tank through said pulsation absorption control valve, wherein said pulsation absorption control valve is arranged in the halfway position of said center bypass line to be adjacent to said directional control valve and includes a plurality of switching positions for establishing or blocking communication of said one communication line positioned between said one main line and said accumulator and for establishing or blocking communication of said other communication line positioned between said other main line and said tank, wherein a bypass passage is provided between said hydraulic actuator and said accumulator for establishing communication therebetween even when said pulsation absorption control valve is in either one of said switching positions, wherein said bypass passage is provided with a switching valve for blocking the communication between said hydraulic actuator and said accumulator by said bypass passage when a pressure in the side of said hydraulic actuator exceeds a predetermined set pressure, and wherein said switching valve is provided inside said pulsation absorption control valve.

2. A hydraulic control device for a working vehicle according to claim 1, wherein said pulsation absorption control valve is provided in said center bypass line in a position downstream of said directional control valve.

3. A hydraulic control device for a working vehicle according to claim 1, comprising:

an engine for driving said hydraulic pump and an exhaust gas purifying device including a filter provided in the exhaust side of said engine to purify an exhaust gas, wherein said pulsation absorption control valve has a switching position for load generation for generating a hydraulic load by throttling a flow passage area of said center bypass line at the time of regenerating said filter in said exhaust gas purifying device.

4. A hydraulic control device for a working vehicle according to claim 3, wherein said pulsation absorption control valve includes first, second, and third switching positions, wherein in said first switching position of these switching positions, the communication between said hydraulic actuator and said accumulator is blocked off in the halfway position of said one communication line, in said second switching position, the communication between said hydraulic actuator and said accumulator is established via said one communication line, and said third switching position is constituted as said switching position for load generation.

5. A hydraulic control device for a working vehicle according to claim 1, comprising:

an engine for driving said hydraulic pump and an exhaust gas purifying device including a filter provided in said exhaust side of said engine to purify an exhaust gas, wherein said pulsation absorption control valve includes a short circuit passage for short-circuiting said center bypass line to the side of said tank for communication and has a switching position for load generation for generating a hydraulic load by throttling a flow passage area of said short circuit passage at the time of regenerating said filter in said exhaust gas purifying device.

6. A hydraulic control device for a working vehicle according to claim 5, wherein said pulsation absorption control valve includes first, second, and third switching positions, wherein in said first switching position of these switching positions, the communication between said hydraulic actuator and said accumulator is blocked off in the halfway position of said one communication line, in said second switching position, the communication between said hydraulic actuator and said accumulator is established via said one communication line, and said third switching position is constituted as said switching position for load generation.

7. A hydraulic control device for a working vehicle according to claim 1, wherein said directional control valve and said pulsation absorption control valve are provided in a same valve housing, and said respective communication lines are communicated with said pair of said main lines inside said valve housing.

8. A hydraulic control device for a working vehicle according to claim 1, wherein said pulsation absorption control valve and said directional control valve are provided in a parallel arrangement in such a manner as to extend in parallel with each other on the same plane.

9. A hydraulic control device for a working vehicle according to claim 1, wherein said bypass passage is provided with a check valve for allowing a flow of pressurized oil from said hydraulic actuator to said accumulator and preventing a reverse flow thereof.

10. A hydraulic control device for a working vehicle according to claim 9, wherein said check valve is provided inside said switching valve.

* * * * *